United States Patent [19]

Henderson

[11] Patent Number: 4,794,742

[45] Date of Patent: Jan. 3, 1989

[54] MULTI-CONIC SHELL AND METHOD OF FORMING SAME

[76] Inventor: Charles E. Henderson, P.O. Box 4550, Berkeley, Calif. 84704

[21] Appl. No.: 841,501

[22] Filed: Mar. 19, 1986

[51] Int. Cl.[4] ..... E04B 1/38; E04B 7/00

[52] U.S. Cl. ..... 52/80; 52/81; 52/82; 52/792; 52/808; 405/21; 405/29; 428/119

[58] Field of Search ..... 52/80, 81, 82, 792, 52/808, 144; 405/21–29; 428/119

[56] References Cited

U.S. PATENT DOCUMENTS

| | | | |
|---|---|---|---|
| 905,596 | 12/1908 | Smith | 405/21 |
| 2,247,608 | 7/1941 | De Groff | 52/82 X |
| 2,549,189 | 4/1951 | Gabo | 52/144 X |
| 2,880,473 | 4/1959 | Shwayder | 52/808 |
| 3,013,641 | 12/1961 | Compton | 52/792 X |
| 3,091,087 | 5/1963 | Danel | 405/29 |
| 3,525,663 | 8/1970 | Hale | 52/792 X |
| 3,663,346 | 5/1972 | Schoen | 52/80 X |
| 3,663,347 | 5/1972 | Schoen | 52/80 X |
| 3,774,358 | 11/1973 | Hale | 52/81 |
| 3,834,487 | 9/1974 | Hale | 52/144 X |
| 3,876,492 | 4/1975 | Schott | 52/792 |
| 3,919,382 | 11/1975 | Smarook | 428/119 X |
| 3,919,446 | 11/1975 | Smarook | 428/119 X |
| 3,959,937 | 6/1976 | Spunt | 52/81 |
| 4,306,391 | 12/1981 | Crosly | 52/80 X |
| 4,362,432 | 12/1982 | Conover | 405/21 X |

FOREIGN PATENT DOCUMENTS

| | | | |
|---|---|---|---|
| 150122 | 2/1953 | Australia | 52/808 |
| 837813 | 3/1970 | Canada | 52/792 |
| 45677 | 5/1966 | German Democratic Rep. | 52/81 |

OTHER PUBLICATIONS

The Engineering Journal, Oct. 1963, p. 18, A copy in GA4354.

*Primary Examiner*—Alfred C. Perham
*Attorney, Agent, or Firm*—Alan H. MacPherson; Terrence E. Dooher; Richard Franklin

[57] ABSTRACT

A multi-conic shell and a process of creating multi-conic shells from flat materials which are bent and thereby forced into the configuration of continuous regions from oppositely oriented, tangential cones to create variably configured building structures and variably configured lightweight structural panels. The process of creating multi-conic shells from connecting cone segments corresponding to a theoretical array of regular (opening downward) and inverted (opening upward) cones provides an unlimited number of variations for the design of building structures and the design of structural panels. Such multi-conic structures achieve excellent strength to weight ratios by distributing loads into tension and corresponding tetrahedron structures which propogate throughout the shell. One embodiment is a building structure wherein a number of generally two-dimensional panels constructed of plywood or other flat materials are raised and forced into multi-conic surface positions by the use of winches, or other mechanical devices thus creating one or more multi-conic shells. Another embodiment is a structural panel manufactured by bending flat panels or stamping, vacuum forming, or casting materials into multi-conic shells which attach to one or more panel surfaces to create a sandwich type structural panel.

22 Claims, 25 Drawing Sheets

78

79

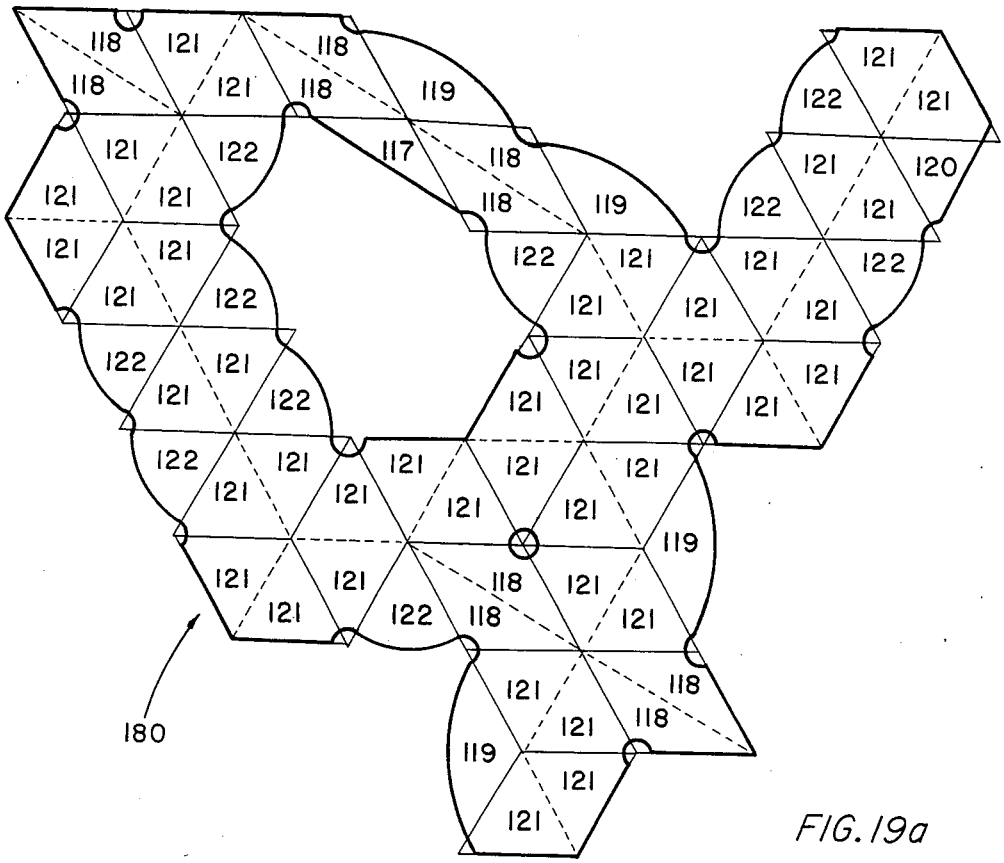
118
121
118
118
121
118
119
121
122
121
121
122
117
118
121
120
121
121
118
119
122
121
121
121
122
121
121
122
121
122
121
121
121
121
122
121
121
121
121
121
121
122
121
121
121
121
121
121 j1
j1a j2
j2a
j3
j3a 180
124 j3'
j4'
j2'
j5'
j6'
j1'
j10'
j7'
j8'
j9'
j4
j4a j5
j5a j7
j7a j9
j9a
j6
j6a j8
j8a j10
j10a

MULTI-CONIC SHELL AND METHOD OF FORMING SAME

FIELD OF THE INVENTION

This invention relates to building structures and structural panels constructed from thin materials to create shell structures, and in particular to multi-conic shell structures.

BACKGROUND OF THE APPLICATION

The increasing cost of building materials and the increasing global populations which lack sufficient housing has created the need for permanent structures built with a minimum of materials. Further, the increasing cost of delivering payloads to orbital and sub-orbital platforms has created the need for ultra-lightweight structures and structural support componens. An approach now common in the design of architectural structures is to create thin shells which are congruent to curved surfaces. Examples include the hyperbolic paraboloid (hy-par), the geodesic dome and other domed structures, the Quonset hut and other cylindrical structures, and conical shaped structures. An approach now common in the design of lightweight support structures, such as in air and space craft, is to create truss frameworks or sandwich structural panels. Examples include the octahedron-tetrahedron (oct-tet) truss and hexagonal or honey-comb sandwich panels. Typical design elements for both minimum-material building structures and lightweight structural panels include the transformation of stress loads into tension and compression forces within the structure, and the distribution of stress loads throughout the structure.

Of particular interest to the present invention are shell structures composed of flat two-dimensional materials which are forced into bending, and thus curved to create a structure of sufficient strength. Such structures correspond to surfaces known as developable surfaces, in that they can be made to easily lie flat. Structures corresponding to developable surfaces include cylindrical and conical structures but not spherical or hyperbolicparaboloid shaped structures.

U.S. Pat. No. 3,990,208 issued Nov. 9, 1976 to Charles E. Henderson discloses a method of forming a single conical structure from a two-dimensional panel structure comprising from one to three contiguous quadrants of a theoretical square configuration. The two-dimensional panel structure is flexed into a downwardly opening conical configuration thus creating a single conical structure.

U.S. Pat. No. 2,767,722 issued Oct. 23, 1956 to Gerald N. Smith discloses a foldable umbrella which is deployed by bending a sheet of inexpensive form-sustaining material cut and scored and folded to form a single cone shaped umbrella-like body structure for use as an emergency umbrella.

U.S. Pat. No. 4,509,302 filed Sept. 27, 1982 by Eugene R. Donatelli discloses a building structure formed of a plurality of stiff triangular panels outwardly bowed to form a single conical structure for use as a solarium.

U.S. Pat. No. 1,175,585 issued Mar. 14, 1916 to George J. Berman discloses an umbrella including an outer sheet comprised of a generally flat material which is bent and thus curved to form a single conical surface.

While useful, the above structures do not lend themselves to buildings that can be extended horizontally in multiple sections to create variably configured architectural environments, nor do they lend themselves to the creation of structural support systems suitable for inclusion in the interior portion of structural panels.

SUMMARY OF THE INVENTION

In contrast to the above structures, the present invention comprises multi-conic shells which can be variously designed and used for building structures and panel structures.

A shell is a thin rigid or semi-rigid membrane that acts as a structure. A multi-conic shell is defined as a physical shell which is congruent to a multi-conic surface. Typically the multi-conic shell is made of plywood, sheet metal, or plastic, although other materials may also be employed.

A multi-conic surface is defined as a theoretical shape which is a continuous surface area composed of two or more adjacent regions, each region being a portion of the surface of a corresponding cone (called a "parent cone"), each parent cone being tangent to and oppositely oriented from an adjacent parent cone containing an adjacent region. Further, adjacent regions of tangent and oppositely oriented parent cones share a common perimeter segment which is a segment from the line of tangency of the adjacent and oppositely oriented parent cones.

Oppositely oriented cones are cones which open (from vertex to base) in opposite directions. For example, regular (opening downward) cones are said to be oppositely oriented from inverted (opening upward) cones. Adjacent and oppositely oriented parent cones of adjacent regions are tangent along mutual generator lines which connect the vertex of one parent cone to the vertex of the adjacent and oppositely oriented parent cone.

It can be shown that a multi-conic shell is a developable surface (also called a simple curved surface) which can be rolled out and made to lie flat and which can be made from a flat surface which is flexed and thereby curved to form a curved developable surface.

In one preferred embodiment, a multi-conic shell building structure is formed by assembling a flat panel(s) at or near ground level from a plurality of common rectangular materials such as common 4 foot by 8 foot sheets of plywood, attaching the flat panel(s) to support beams (which act as permanent support for the structure upon completion), lifting appropriate end-points of the support beams and in so doing flexing and thus curving the flat panel(s) into the shape of a multi-conic surface(s). This method is appropriate for constructing small structures and enables all structural components to be assembled at ground level.

In another preferred embodiment, a multi-conic shell building structure is formed by assembling a fixed array of tripod support beams, assembling a flat panel(s) at or near ground level from a plurality of common rectangular materials, attaching temporary support beams to the flat panel(s), drawing appropriate end-points of the temporary support beams and thereby the flat panel(s) toward appropriate positions on the array of tripod support beams thus flexing and curving the flat panel(s) into the shape of a multi-conic surface(s), attaching the panel(s) at appropriate positions to the tripod support beams, and removing the temporary support beams. This method is appropriate for constructing large building structures.

Multi-conic shell building structures thus constructed utilize a minimum of materials while extracting tensile and compression strength out of existing materials to achieve a high degree of stability and structural resistance to various live loads. Further, such structures can be constructed of conventional building materials, assembled at or near ground level, and raised quickly.

In another preferred embodiment, a multi-conic shell building structure is formed as in one of the two embodiments above, and, in addition, is formed so that all parent cones correspond to a theoretical array of cones. The theoretical array being an array of intersecting regular and inverted right circular cones where the vertices of all regular cones lie in a plane which contains the bases of all inverted cones, and likewise, where the vertices of all inverted cones lie in a plane which contains the bases of all regular cones. Further, all vertices of both regular and inverted cones respectively form an equilateral triangular pattern. By utilizing such a theoretical array, resulting regions can be standardized into two typical "cone segments" defined as "tri-parts" or "hex-parts". Tri-parts correspond to one third segments of parent cones and hexparts correspond to one sixth segments of parent cones. Building structures constructed of tri-parts and hex-parts thus correspond to the theoretical array and tend to exhibit maximum structural stability in that tri-pod structures (tetrahedrons) propagated in the shell and the foundation approach an equilateral configuration. Further, building structures constructed to correspond to the theoretical array may enable maximum utilization of rectangular materials (such as plywood) in the construction of the multi-conic shell if the vertex angle of all parent cones equals approximately 97 degrees.

In another preferred embodiment, a structural panel is formed by constructing a multi-conic shell(s) from a flat panel(s), attaching multi-conic shells together (where more than one are utilized), and attaching the group of multi-conic shells to one or two flat panels thus creating a sandwich type structural panel. Alternatively the multi-conic shell(s) can be made by stamping, vacuum forming, or casting. A structural panel, thus constructed, enables high strength per unit weight ratios to be realized.

Multi-conic shell building structures and multi-conic shell structural panels may be constructed to correspond to a theoretical array which has been altered in order for building structures to accommodate steep terrain or in order for structural panels to accommodate non-flat shapes such as airfoils, nose cones, or curved wall sections.

This invention will be more fully understood in light of the following detailed description taken together with the following drawings:

BRIEF DESCRIPTION OF THE DRAWINGS

FIG. 11*b*-1 thru 11*b*-3 are a plan view and exploded views of the portion of the theoretical array shown in FIG. 11*a;*

FIGS. 13a1 thru 13a-3 are a plan view, and oblique views of two regular and two inverted cones and their respective orientations in the theoretical array which define the borders of a tri-part; an oblique view of a single tri-part is also shown;

FIGS. 13-1 thru 13b-3 are a plan view, and oblique views of two regular and two inverted cones and their respective orientations in the theoretical array which define the borders of a hex-part; an oblique view of a single hex-part is also shown;

FIG. 14a-1 thru 14a-6 are six oblique views of various tri-part configurations shown with the parent cone;

FIGS. 14b-1 thru 14b-6 is six oblique views of various hex-part configurations shown with the parent cone;

FIG. 19a is a plan view of a possible multi-conic surface showing each cone segment delineated, each cone segment corresponds to a parent cone in the theoretical array of regular and inverted cones;

FIG. 19b is an oblique view of a multi-conic shell building structure as built from the design shown in FIG. 19a with shadows cast from a vertical (zenith) sun position, and skylight windows delineated;

FIGS. 19c-1 thru 19c-11 are plan views of the perimeter and hyperbolic connection lines of the multi-conic shell building structure shown in FIG. 19b including component multi-conic shells as they appear in their uncurved, flat configuration;

DETAILED DESCRIPTION

Figure 1:
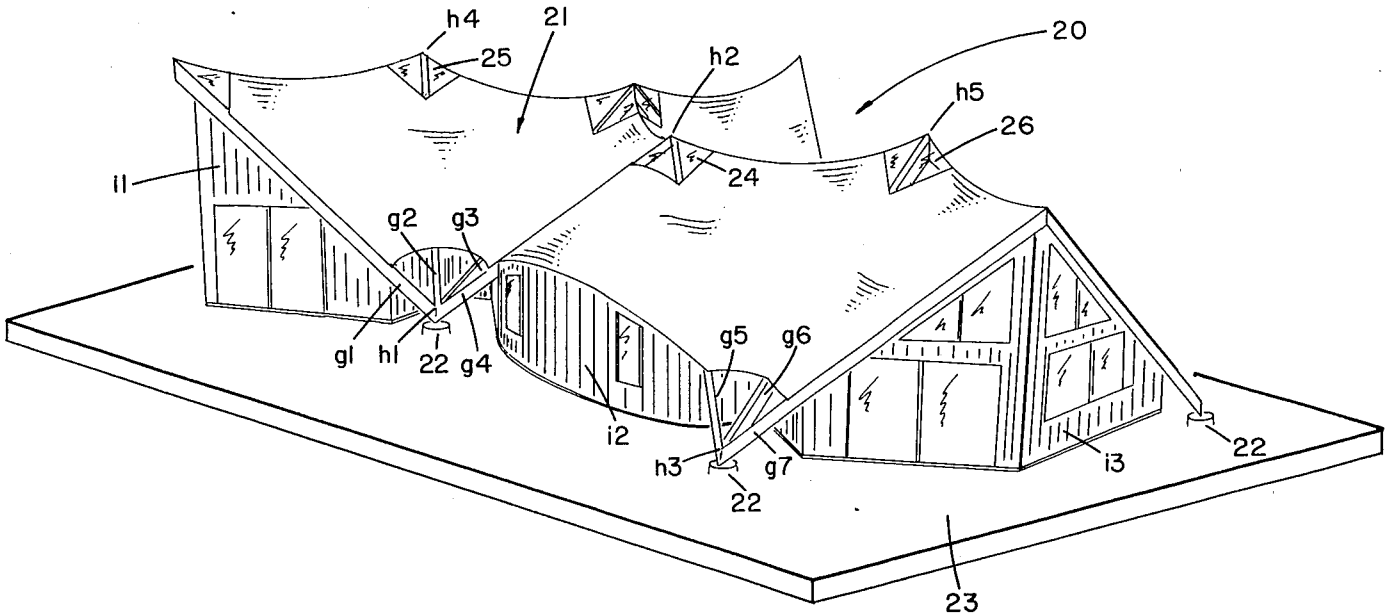
FIG.1 is a perspective view of a building constructed according to the teachings of and expressing a possible configuration of the present invention.
Figure 20:
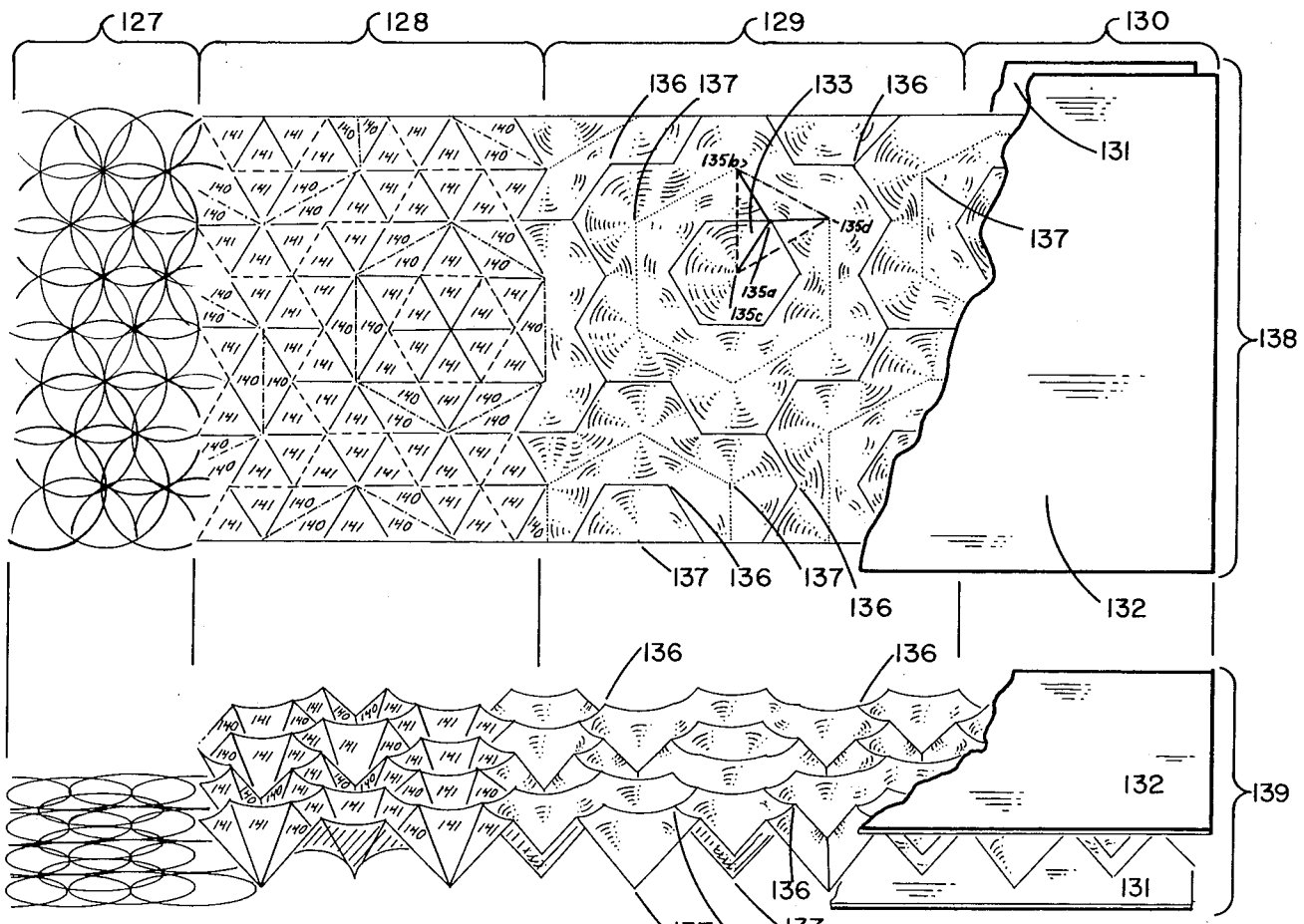
FIG. 20 is a plan and an oblique view of the metamorphosis of a multi-conic shell structural panel showing, from left to right, a plan view of the theoretical array, a design using cone segments, the multi-conic shell, and the completed sandwich structural panel with top and bottom flat panels attached.
Figure 21A:
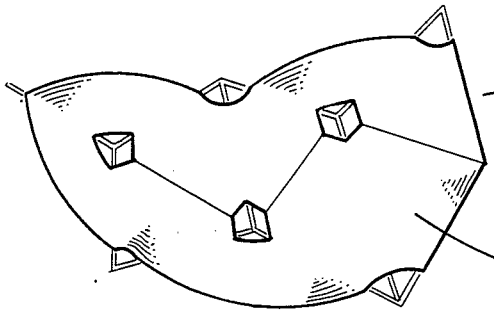
FIGS. 21a thru 21d are a plan view and three oblique views of three multi-conic building structures (identical in plan view) built on three different sloping ground levels.
Figure 21B:
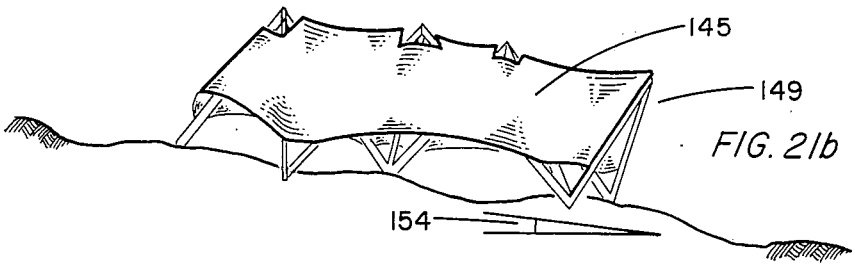
Figure 21C:
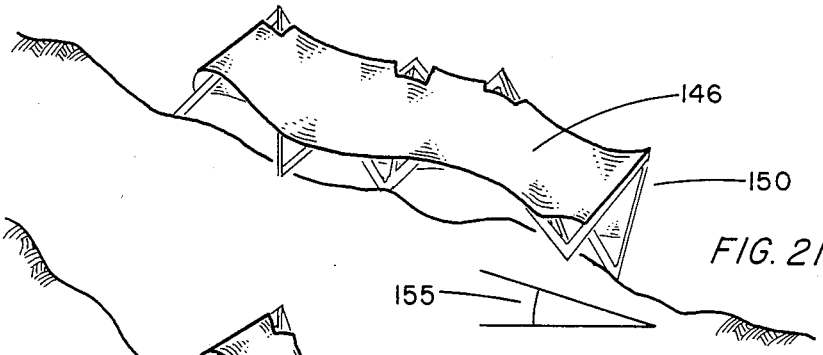
Figure 21D:
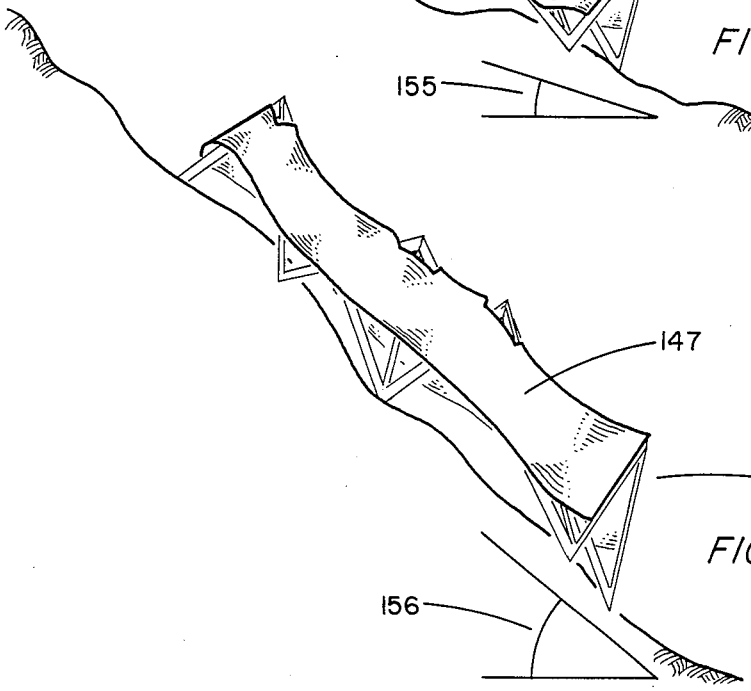

The invention concerns thin curved shell structures which can be variously connected to existing structures or other likewise curved shell structures to create an improved load supporting structural component for use as a building structure as shown in FIG. 1, or structural panel as shown in FIG. 20. The advantage of curved shell structures built or manufactured in accordance with the teachings of the invention lies in increased strength per unit weight and ease of manufacture. The strength of the shell structure results from the distribution of loading forces throughout the entire structure via the conversion of compression and bending forces into tension forces. Ease of manufacture of these curved shell structures arises from the ability to use common two-dimensional materials such as plywood, sheetmetal, fiberglass, plastic sheeting, or other flat materials in their construction as will presently be described.

Figure 2:
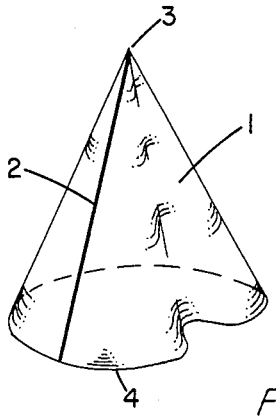
FIG. 2 is an oblique view of a cone.

The invention in all embodiments is related to the geometry of oppositely oriented tangential cones. A cone 1, as shown in FIG. 2, is a conical surface generated by a moving straight line 2 (called the generator line) beginning at a fixed point 3 (called the vertex), and tracing a fixed curve such as a circle, ellipse, or other continuous and end-to-end connecting curve 4, provided curve 4 does not lie in a plane containing the vertex. The fixed curve 4 may lie in a plane in which case it can be called the base although the cone may extend infinitely beyond the fixed curve and therefore beyond the base. A cone 1 ending on the fixed curve 4 lying in a plane is shown in FIG. 2. A cone is said to be oriented in the direction in which it opens. A cone opens from the vertex and toward the base. Cone 5a shown in FIG. 3 with its base 6a at or near ground level or other reference plane 8 and its vertex 7a located "above" the base 6a (i.e. on a first selected side of plane 8) is said to be "opening downward" or oriented as a "regular" cone 5a. A cone 5b with its vertex 7b at or near ground level or other reference plane 8 and its base 6b located "above" the vertex 7b is said to be "opening upward" and is thereby oriented as an "inverted" cone 5b. Two cones are said to be "oppositely oriented" if they open in opposite directions. Therefore, inverted cones are said to be oppositely oriented from regular cones in so much as the inverted cones open upwardly and regular cones open downwardly. A group of cones (FIG. 4) which sequentially alternate between regular orientation (such as cones a1–a4) and inverted orientation (such as cones b1–b4) and which are sequentially tangent along mutual generator lines called "primary generators." (such as c1–c7 are said to be "alternately oriented".

A cone, i.e. a conical surface, is a simple curved surface. A simple curved surface is synonymous with a developable surface and is defined as (1) a surface that can be developed, or rolled out, on a plane without stretching or shrinking, and (2) a surface for which the total curvature vanishes identically (See James & James Mathematics Dictionary Third Edition published by D. Van Nostrand Company, Inc. 1968, and Encyclopedic Dictionary of Mathematics published by The MIT Press, 1977, which are incorporated herein by reference). Examples of simple curved surfaces include a cone, a surface of a cylinder, and the tangent plane of a space curve, all of which can be rolled out (i.e. uncurved) and made to lie flat as a two-dimensional surface. The uncurving of a simple curved surface may necessitate a cut in the surface, or several cuts in the surface. For example, a cone must be cut from apex to base in order to permit the uncurving and flattening of the cone surface.

This invention concerns thin physical structures, called "shells", which have the shape of a simple curved surface.

A shell which has the same shape and size as an abstract geometrical surface is said to be congruent to the abstract surface and vice-versa. For example, if a shell has the same shape and size as a given cone, the given cone is said to be congruent to the shell.

In particular this invention concerns a simple curved surface which is congruent to an abstract surface area containing at least a first region of a first cone and a second region of a second and oppositely oriented cone tangent to the first cone along a generator line, where the first and second regions each contain a common segment of the generator line of tangency of the first and second cones. Such an abstract surface area is herein referred to as a "multi-conic surface". A thin material which is fashioned so as to be congruent to a multi-conic surface is herein referred to as a "multi-conic shell".

A cone which contains a region comprising a portion of the surface of the cone is said to be the "parent cone" of the region.

Figure 5:
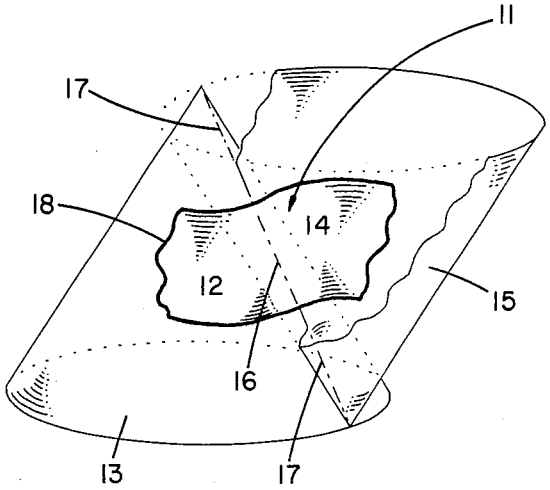
FIG. 5 is an oblique view of a multi-conic surface including a parent regular cone and a parent inverted cone.

FIG. 5 shows a multi-conic surface 11 which includes region 12 of cone 13 and region 14 of alternately oriented cone 15. Region 12 and region 14 have a common boundary, segment 16, which lies along a primary generator 17 which is a generator line of both cone 13 and cone 15. Cone 13 and oppositely oriented cone 15 are mutually tangent along primary generator 17.

The multi-conic surface 11 consisting of the regions 12 and 14 together is a simple curved surface, as previously defined, by virtue of every point on the multi-conic surface being within a region of a cone. Therefore a congruent multi-conic shell 11 consisting of regions 12 and 14 can be uncurved and made to lie flat (without cuts). Conversely, an appropriately shaped flat (two-dimensional) material can be made to bend or flex to thereby attain the shape of a multi-conic surface 11 having a first portion congruent to region 12 and a second portion congruent to region 14, thus becoming multi-conic shell 11.

If the perimeter 18, portions of the perimeter, and/or portions of the interior surface of the multi-conic shell 11 are held rigid (as by the use of support beams, attachment to existing structures, attachment to other curved shell surfaces, foundation points, and/or flat panels) and materials with appropriate thickness and strengths are used in the construction or manufacture of the shell, then the multi-conic shell (e.g. 11) becomes self supporting and is capable of supporting additional live loads. As is well understood throughout the fields of engineering and architecture, an arch or curved surface transfers stresses radially outward from the load point. A multi-conic shell also resists deformation by virtue of its curved shape. A multi-conic shell, as here defined, held rigid and manufactured of sufficiently strong material will therefore deflect impact loads by deflecting stresses encountered radially throughout the multi-conic shell and will resist deformation because of its continuously curved shape.

Figure 6:
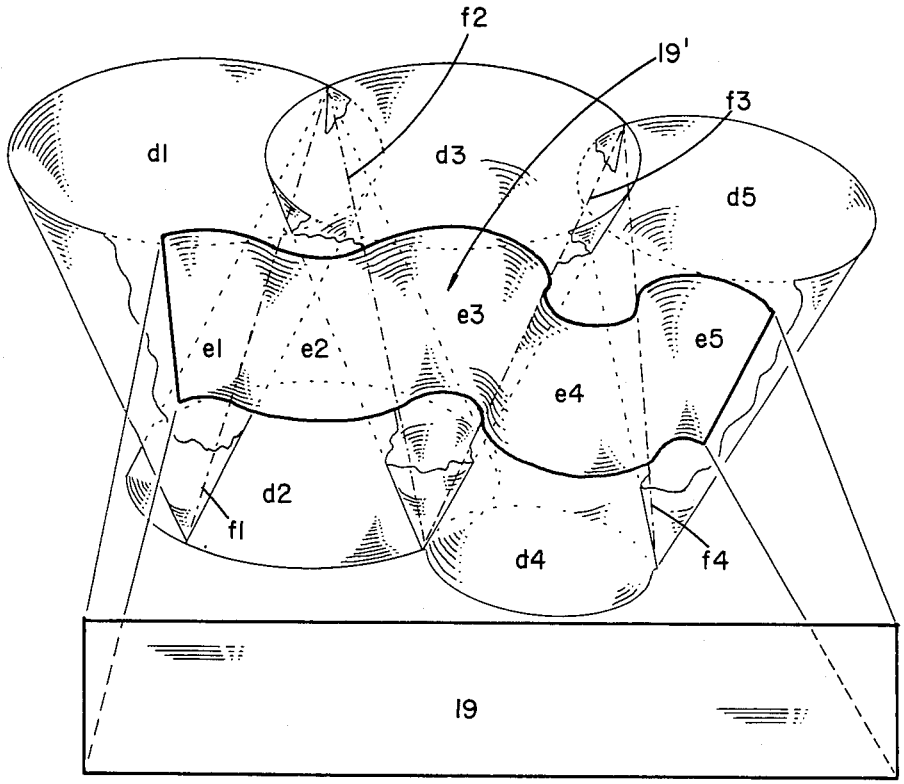
FIG. 6 is an oblique view of a multi-conic surface corresponding to two regular and three inverted cones, the multi-conic surface in its uncurved and flat configuration is also shown.

FIG. 6 shows a group of alternately oriented tangential cones d1–d5, and an originally flat surface shell 19 which has been flexed and thus curved so that it is congruent to the surface 19′ consisting of cone section e1–e5 of cones d1–d5 respectively. Cones d1–d5 are alternately inverted and regular. Section el is tangent to section e2 along primary generator fl, which is tangent to cones d1 and d2. Similarly section e2 and e3 are mutually tangent along primary generator f2; section e3 and e4 are mutually tangent along primary generator f3; and section e4 and e5 are mutually tangent along primary generator f4. Thus a multiconic surface 19′ is formed having 5 regions e1–e5 congruent to regions of alternately oriented tangential cones d1–d5.

Any multi-conic surface 19′ formed as shown in FIG. 6 is a simple curved surface and can therefore be flattened or rolled out without stretching or shrinking. Where a multiconic surface is congruent to cone regions joined at primary generators f1–f4, as in the example shown in FIG. 6, it is possible to flatten the entire multi-conic surface 19′ so that it comprises a single two-dimensional surface 19. In FIG. 6 conical shell regions e1–e5 are shown as flattened panel 19 while joined at their respective primary generators f1–f4 (not shown in panel 19 but shown in multi-conic surface 19′). Likewise, the flat surface 19, or a corresponding flat panel 19 made from suitable flat materials and cut to similar perimeter dimensions, can be flexed and thus curved to approximate the multi-conic surface 19′ of regions e1–e5 thereby forming a multi-conic shell 19′. A multi-conic shell 19′ as shown in FIG. 6 can also be formed by manufacturing processes which do not require bending, for instance by casting a liquid or molten or otherwise hardening material into a mold which has the form of a multi-conic shell.

In the process whereby a multi-conic shell is formed from a flat (two-dimensional) material which subsequently is flexed and thus curved to approximate a multi-conic surface congruent to regions of alternately oriented cones, it is typically useful to attach at least a portion of the perimeter of the multi-conic shell to a rigid support. The resulting structure, whether created by the bending process or by casting into a mold has two rather disparate uses. On a large scale the structure may be used as a building or a roof/wall portion of a building. On a smaller scale, the structure may be used in a structural panel, for example as a wall or floor section.

Further, as will be shown, if multiple intersecting and alternately oriented cones are arranged to correspond to a pattern of equilateral triangles (hereafter theoretical array), a multi-conic shell can be designed with significant strength per unit weight. The method of forming a building structure, the applications of the theoretical array, and the method of forming a structural panel will subsequently be described.

Method of Forming a Building Structure

A building 20 formed according to the teachings of the first embodiment of the present invention is illustrated in FIG. 1. Building 20 has a multi-conic shell roof/wall portion 21 shaped like (i.e. congruent to) a multi-conic surface as previously discussed. The multi-conic shell 21 is mounted on multiple support beams including beams g1–g7 (other support beams are not shown in FIG. 1). Support beams g1 and g7 act as rigid supports of the perimeter of the multi-conic shell 21 and support beams g2–g6 act as rigid intermediate supports for the multi-conic shell 21. Support beams g1–g4 meet and are joined together at vertex h1 and support beams g4 and g5 meet at vertex h2. Support beams g5–g7 meet at vertex h3. Support beams (such as g2–g5) serve as strut lengths of tripod (tetrahedron) supports (the other strut lengths of the tripods are not shown in FIG. 1). Support tripods generally exist throughout the structure (see FIGS. 8a–8f). These tripod supports act as rigid support for multi-conic shell 21. In such a configuration the vertices of inverted cones which correspond to the multi-conic shell, such as h1 and h3, form foundation support points 22, and the vertices of regular cone surfaces such as h2, h4 and h5 form top vertex points of the roof/wall structure 20. Vertical side walls i1–i3 extend from foundation level 23 to roof/wall structure 21 to complete the building. At the vertices corresponding to regular cones (such as h2, h4 and h5) a skylight (24–26 respectively) may be included, if desired.

To construct a building structure such as the one illustrated in FIG. 1 four steps are followed:

STEP ONE. The position of each cone region which together comprise a multi-conic surface in three dimensional space is designed and then the perimeter of a corresponding two-dimensional surface is calculated using the general approach which follows. The building structures designed and built as shown in FIGS. 7a–7f and 8a–8f are used here as an example.

1. The position of each parent cone vertex (for example 40'–43' and 49' in FIG. 7a of alternately oriented cones q1–q5) is specified. The designer employing the principals of this invention must determine the vertices of the alternately oriented regular and inverted parent cones which will best scale and position the multi-conic shell as design requirements dictate. Generator lines connecting adjacent regular cone vertices with inverted cone vertices define primary generators (e.g. n1'–n5'). Since the position of each cone vertex has been efined, the lengths of each primary generator is easily calculated.

Figure 7A:
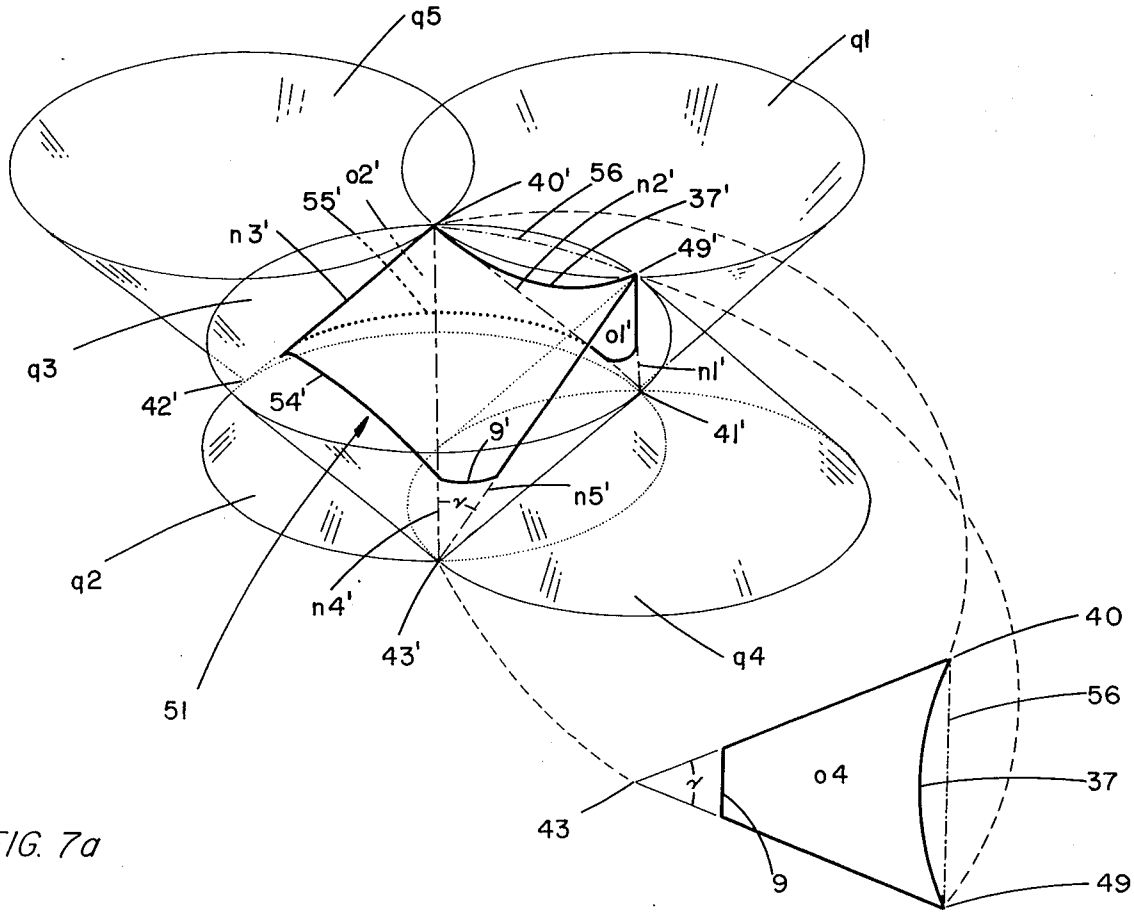
FIG. 7*a* is an oblique view of a multi-conic surface corresponding to two regular cones and two inverted cones, a region of the multi-conic surface is shown in its uncurved and flat configuration.

In the case of FIG. 7a five parent cones q1–q5 have been chosen, two regular cones q2 and q4, and three inverted cones q1, q3 and q5. The vertex 40' and 49' of regular cones q2 and q4 respectively and vertex 41', 43' and 42' of inverted cones q1, q3 and q5 respectively have been specified. Although this is a simple example the same process may be employed to construct multi-conic shells with a much greater number of parent cones as, for example, structure 180 in FIG. 19b. By selecting the vertices 40'-43', and 49' (FIG. 7a) and therefore defining the primary generator lines n1'–n5', the primary generator bounds of each cone region are set.

2. A space curve connecting primary generators is specified for each cone region (e.g. space curve 37' in FIG. 7a). This space curve 37' marks the perimeter of the cone region o4' between primary generators n4 and n5. The manner in which each region connects from one primary generator to its other primary generator is left to the prerogative of the designer. He can select any space curve that connects a portion of one primary generator line to the other primary generator line. He must, however, select a space curve for each region so that a cone surface generated by moving a straight line beginning at the vertex and tracing the space curve, is tangent to the surface of each adjacent, oppositely oriented, and mutually tangent surface of a cone at the mutual primary generator. This must be accomplished for each cone region comprising the multi-conic surface. In the example in FIG. 7a cone region o4' derived from parent cone q3 is bounded by primary generator n4 and n5. The space curve 37' has been selected to connect the two primary generators n4 and n5. Similarly, cone regions o1', o2' and o3' are bounded by their respective primary generators n1' and n2', n2' and n3', and n3' and n4', and space curves 37', 55' and 54' respectively.

3. A cone surface is generated for each region by moving a straight line beginning at the vertex and tracing the space curve. In the example of FIG. 7a the cone surfaces q1–q3 are easily determined because all three cones are right circular cones and their bases are therefore circular. For more complex space curves the cone surface can be approximated by multiple rays which intersect at the cone vertex and pass through the space curve at small increments.

4. The interior surface angle (e.g. $\gamma$) at the vertex of the parent cone between the two primary generator lines is determined. This surface angle $\gamma$ can be determined in a variety of ways using trigonometry, calculus, or other numerical methods. A solution for the interior surface angle of cone rgions which are part of a theoretical array of right circular cones is shown subsequently; however, for cones with elliptical bases, or cones with surfaces described by exotic space curves the following general methodology can be employed:

(a) Determine the surface distance (for example line 56 on the surface of cone q3 in FIG. 7a) from the intersection of the space curve 37' with one primary generator line n4 to the intersection of the space curve 37' with the other generator line n5. This surface distance is the shortest distance between the two intersection points measured on the surface of the parent cone q3. For example, region o4' in FIG. 7a intersects primary generators n4 and n5 at points 40' and 49' respectively. The shortest surface distance between intersection points 40' and 49' is equal to the length of line 56.

(b) Solve for the lengths from the vertex (for example vertex 43' in FIG. 7a) of the parent cone to the intersections 40' and 49' of the space curve 37' with the two primary generators n4 and n5.

(c) Solve for the interior surface vertex angle (for example surface vertex angle $\gamma$ in FIG. 7a) of region o4' between the two primary generator lines n4 and n5. This problem is simplified since the surface of any region is developable and can be made to lie flat with all surface angles and surface line lengths unchanged (see definition of developable surface above). If a cone region (for example region o4') is thus made to lie flat as corresponding flat region o4 (FIG. 7a), the surface distance between the two points of intersection 40 and 49 of the space curve 37 with the two primary generator lines n4 and n5 is equal to the length of a straight line 56 connecting these same points. The two primary generators n4 and n5 and the straight line 56 which connect the above points of intersection 40 and 49 create a triangle (defined by points 43, 40, and 49 as shown in flat region o4). The lengths of all three sides of this triangle are known, therefore the solution to the surface vertex angle $\gamma$ of the cone region is easily determined.

5. Divide the surface vertex angle (e.g. $\gamma$) determined above into angular increments small enough to satisfy the accuracy of the application and determine, at each increment, the distance from the cone vertex (e.g. 43') to the space curve (e.g. 37'). This can be accomplished using well-known analytical geometry techniques in three space for solving the intersection of a straight line and a curve and is not shown here. In the example shown, the space curve 37'approximates a hyperbola (the derivation of hyperbolic intersections of similarly oriented cones is described in detail in a subsequent section discussing the theoretical array).

6. Plot the correct perimeter dimensions on scale plan drawings or directly on flat materials that are assembled for the construction of a multi-conic shell building structure.

Additional space curves (for example space curve 9') defining the perimeter of cone regions (for example cone region o1') near parent cone vertices (for example vertex 43') can be likewise calculated. In the example, space curve 9' of cone region o4' is shown as line 9 in the corresponding uncurved and flat region o4.

The above specifications are made by the designer and can vary greatly from one implementation to another to accommodate variable design requirements. This design process determines a specific implementation of the invention and determines the position and dimensions of all components of the multi-conic shell.

Figure 7B:
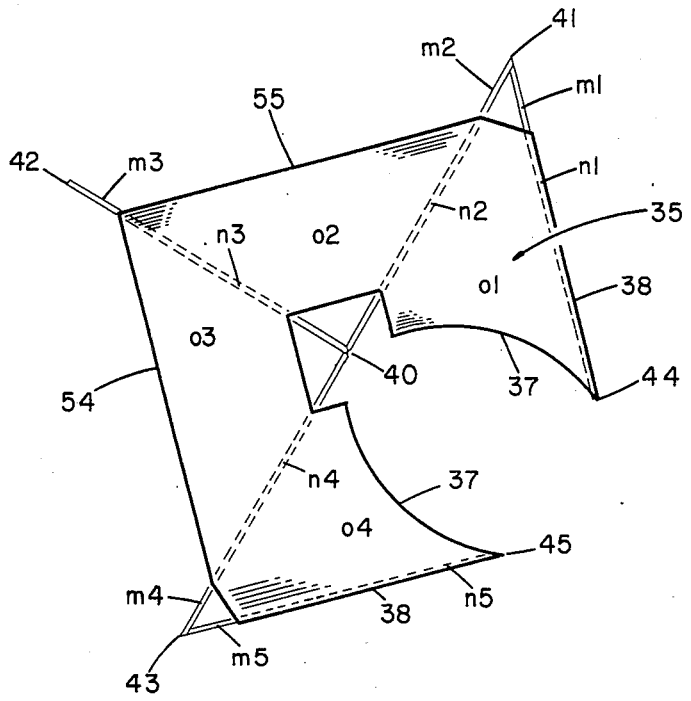
FIG. 7*b* is a plan view of a multi-conic shell building structure corresponding to the multi-conic surface in FIG. 7*a*, in its uncurved and flat configuration and ready for raising.
Figure 7C:
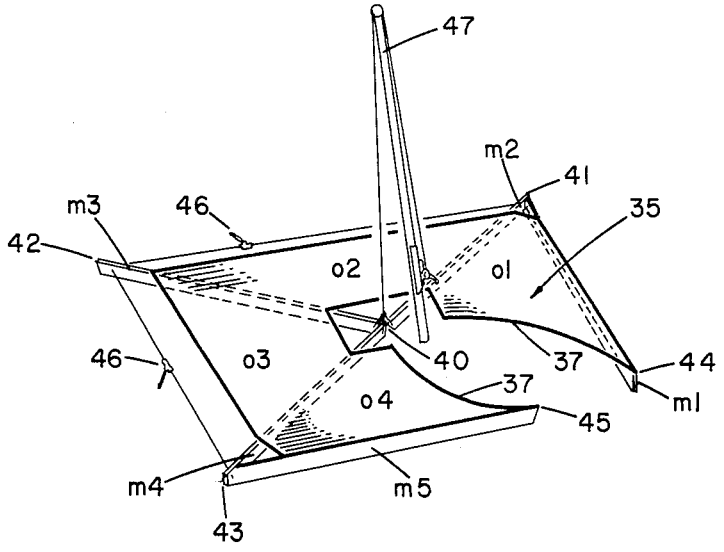
FIG. 7*c* is an oblique view of the building structure shown in FIG. 7*b* with a crane assembly in place.
Figure 7D:
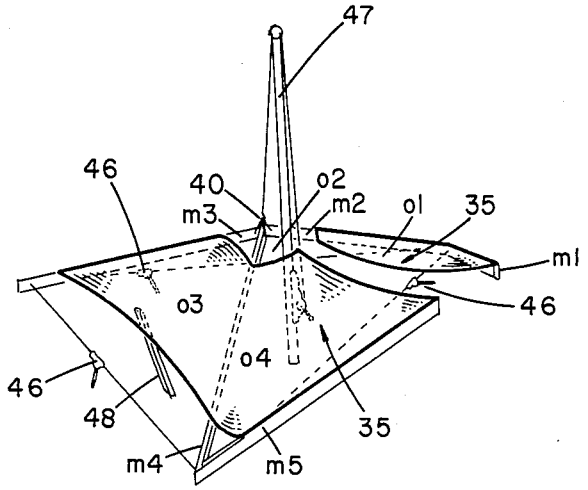
FIG. 7*d* is an oblique view of the building structure of FIGS. 7*a*–7*c* shown partially raised.
Figure 7E:
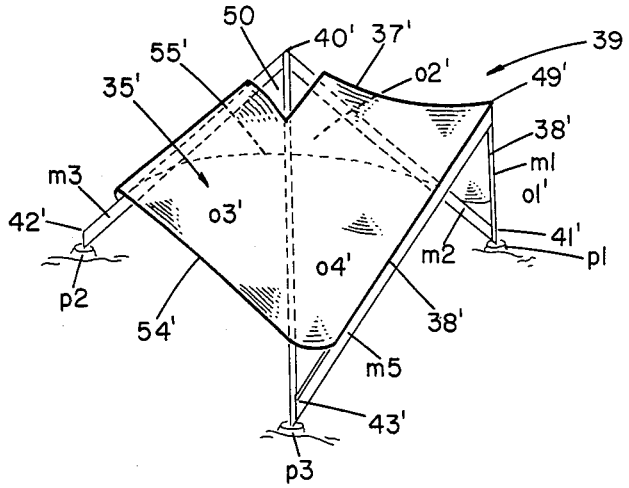
FIG. 7*e* is an oblique view of the building structure of FIGS. 7*a*–7*d* shown completely raised.
Figure 7F:
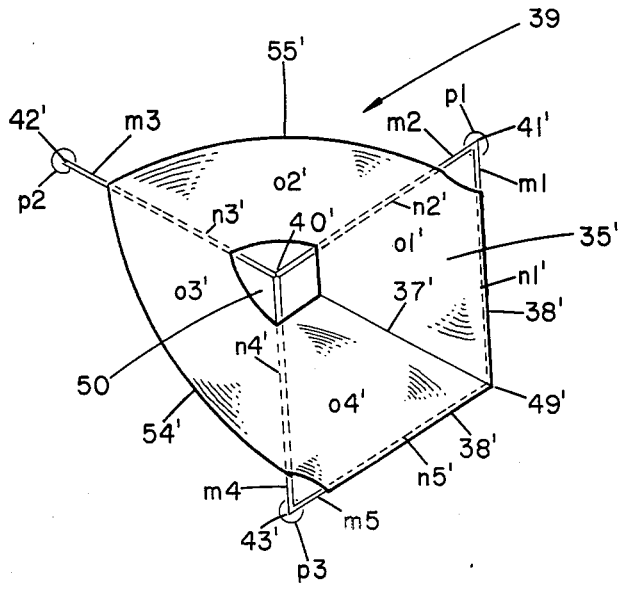
FIG. 7*f* is a plan view of the building structure of FIGS. 7*a*–7*e* shown completely raised.

For example the multi-conic surface 51, as shown in FIG. 7*a* is designed such that cone region o1' will meet and attach to o2', o2' to o3', and o3' to o4', thus forming multi-conic surface 51 which corresponds to multi-conic shell 35' (FIGS. 7*e* and 7*f*). The design may also accommodate the attachment of a plurality of multi-conic shells as, for instance, multi-conic shell 36' and 171 in FIG. 8*f*. Thus a roof/wall structure having a desired multi-conic shell layout is devised. Further examples of such a design are shown in plan view in FIG. 19*a* and oblique view in FIG. 19*b*.

As described in detail below, a pattern may be devised so that each cone region has a parent cone in a theoretical array of regularand inverted cones such that the vertices of the regular cones define intersections in an array of equilateral triangles. This array provides maximum distribution of stress loading along parent cone vertex to parent cone vertex connecting primary generators by virtue of all primary generators being of equal length and all vertices having equal separation. The derivation and use of the theoretical array in designing a multi-conic shell is discussed below.

Figure 8A:
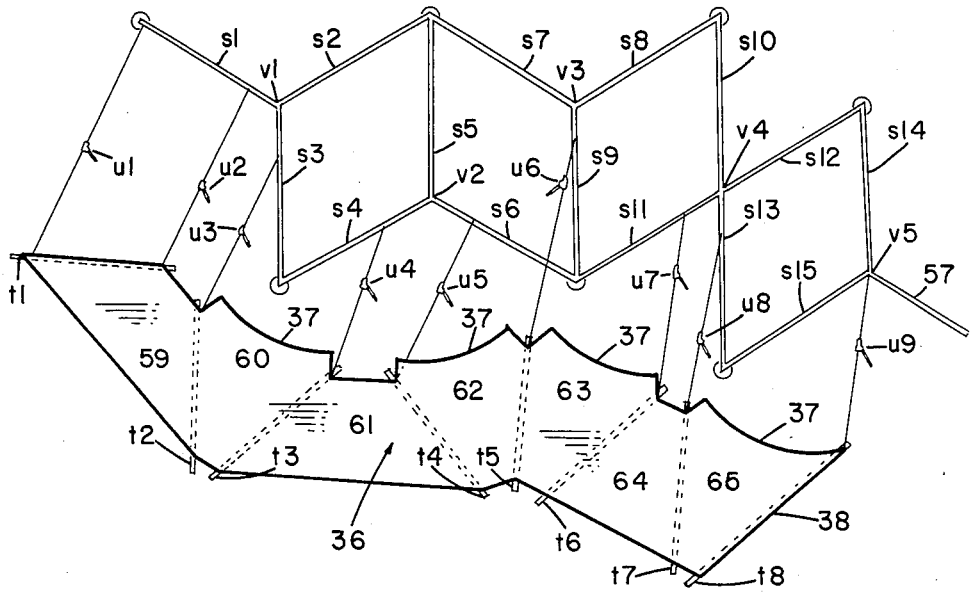
FIG. 8*a* is a plan view of a multi-conic shell building structure shown with the multi-conic shell assembled in its uncurved and flat configuration at or near ground level and positioned beside five tripod (tetrahedron) beam supports with winches attached.
Figure 8B:
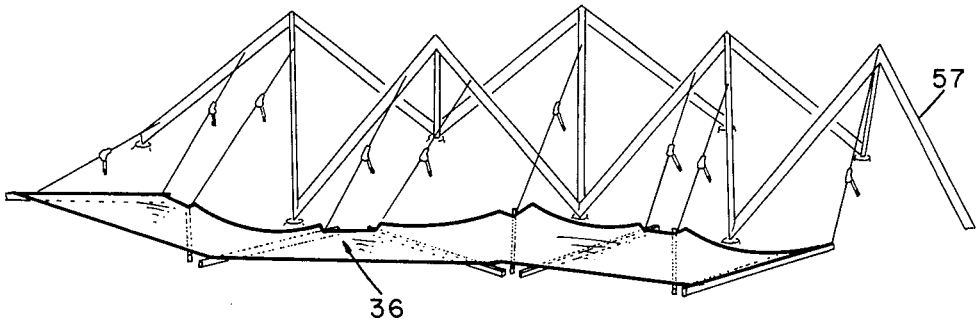
FIG. 8*b* is an oblique view of the building structure shown in FIG. 8*a;*
Figures 1, 2, 3, 4, 5, 6, 7, 8, 9, 10, 11, 19C:
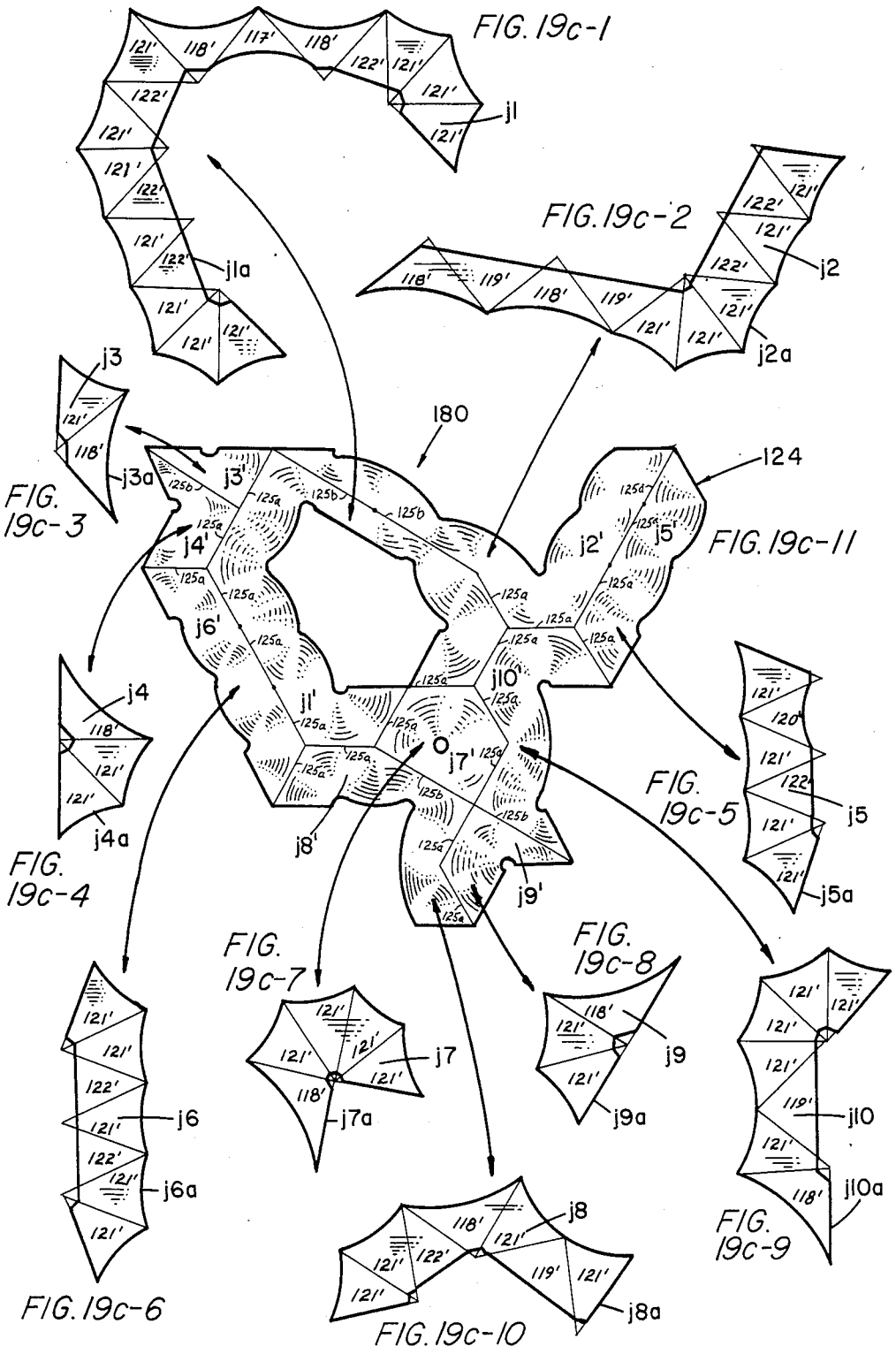

STEP TWO: Generally flat two-dimensional panels corresponding to multi-conic surfaces in their uncurved and flat configuration are constructed using the perimeter calculations from Step One. One or more flat two-dimensional panels (35 in FIGS. 7*b* and 7*c*, and 36 in FIGS. 8*a* and 8*b*) are initially constucted at or near ground level. FIGS. 7*b* and 8*a* show plan views of flat panels 35 and 36 respectively, constructed at ground level. FIGS. 7*c* and 8*b* show oblique views of the same panels respectively. Flat-regions o1–o4 will become cone regions o1'–o4' (as in FIGS. 7*e* and 7*f*) and flat regions 59–65 will become cone regions 59'–65' (as in FIG. 8*e*) when the structures are raised and completed. FIG. 19*c* shows a plan view of ten flat panels j1–j10 as they might appear constructed at or near ground level for a more complex structure.

It may be preferred that each flat two-dimensional panel (such as panel 35 in FIG. 7*b*) be constructed from a plurality of rectangular panels (not shown) such as plywood, sheet metal, or other suitable flat material in order to encompass the entire area of the flat panel. In such a scheme, each rectangular panel (e.g. k1 in FIGS. 9*a*–9*d*) can be attached to another (e.g. k2 in FIGS. 9*a*–9*d*) by use of an edgewise lap or other suitable lap joint. As shown in FIGS. 9*a*–9*d* a simple overlap 29, a tappering scarf lap 30, a mitered scarf lap 31, and self locking scarf lap 32 are preferred in the case of plywood. Connection between two panels (e.g. k1 and k2) is secured by bolt 33 or adhesive 34 fasteners or other suitable fasteners.

The rectangular panels together form a larger two-dimensional panel (such as panel 35 in FIGS. 7*b* and 7*c*, or panel 36 in FIGS. 8*a* and 8*b*) which correspond to the flat or uncurved configuration of a multi-conic surface. The two-dimensional panels are cut along the perimeter, if necessary, to those perimeter dimensions that correspond to the multi-conic surface(s) in its uncurved and flat configuration as determined in Step One.

Typically the perimeter of the flat two-dimensional panel is cut or otherwise fashioned to include curves 37 (as shown in FIGS. 7*a*–7*c*, and 8*a*) which are flexed and thus curved to become hyperbolic line segments 37' (as shown in FIGS. 7*e* and 7*f*, and FIGS. 8*d*–8*f*). The hyperbolic line segments generally correspond to the intersection of a parent cone (such as q3 in FIG. 7*a*) with another parent cone of similar orientation (such as q1 in FIG. 7*a*) or with a flat surface such as the vertical walls of a conventional building (not shown).

Typically the perimeter of the flat two-dimensional panel also includes line segments 38 (FIG. 7*b*) which correspond to generator line segments n1' and n4' when the structure is erected. All perimeter dimensions of the flat two-dimensional panel are measured and cut so they approximate the boundaries of the designed (see Step One) multi-conic surface in their uncurved and flat configuration.

STEP THREE: The two-dimensional panels (panel 35 in FIGS. 7*b* and 7*c*, and panel 36 in FIGS. 8*a* and 8*b*) are raised and forced by bending to become mult-iconic shells by the use of winches, cranes, or other mechanical devices thus creating a multi-conic shell (multi-conic shell 35' in FIGS. 7*e* and 7*f*, and multi-conic shell 36' in FIGS. 8*d*–8*f*) congruent to a multi-conic surface. The raising and bending is best accomplished by one of two methods:

Method 1. The first method of raising a building structure comprising a multi-conic shell is shown by example in FIGS. 7*b*–7*f*. and generally comprises the construction of a flat panel, the attachment of support beams, the raising of support beams at ends which will approximate the vertices of regular cones when the structure is complete, and the complete raising of these support beams and thus the bending of the flat panel into a multi-conic shell.

FIG. 7*b* shows a top view and FIG. 7*c* an oblique view of a flat two-dimensional panel 35 which is attached to support beams m1–m5, along lines n1–n5 (FIG. 7*b*). Lines n1–n5 become generator lines n1'–n5' (FIG. 7*f*) and also become tangent to cone regions o1'–o4' when the building structure 39 is raised as shown in FIGS. 7*e* and 7*f*. The panel 35 is connected to support beams m1–m5 while the two-dimensional panel 35 is at or near ground level. This attachment is accomplished by the use of bolts, screws, adhesives, or other suitable attachment mechanism (not shown). Beams m2–m4 are placed and attached so that they extend from point 40 to the points 41–43 respectively. Point 40 becomes vertex 40' when the structure 39 is complete as shown in FIGS. 7*e* and 7*f*. Vertex 40' is the vertex of regular parent cone q2 as shown in FIG. 7*a*, and parent cone q2 is the parent cone of regions o2' and o3' in FIGS. 7*e* and 7*f* when the structure 39 is complete.

Beam m1 is placed and attached so that it extends from point 44 to point 41 and beam m5 is placed and attached so that it extends from point 45 to point 43. Points 43 and 41 will become the vertices 43' and 41' of two inverted parent cones q1 and q3 (FIG. 7*a*) and inverted cones q1 and q3 are the parent cones of regions o1' and o4' respectively. Once the two-dimensional panel 35 is raised as shown in FIGS. 7e and 7f, thus becoming a multi-conic shell 35', the beams m1–m5 act as rigid support of the multi-conic shell 35'.

As shown in FIG. 7d the two-dimensional panel 35 and the attached generator beams m1–m5 are lifted upwardly from the ends which converge at point 40 of the generator beams m2–m4 that, at the completion of the structure raising, will correspond to regular cone vertex 40' as shown in FIGS. 7e and 7f. This lifting is accomplished by the use of a crane 47 or other mechanical lifting device as shown in FIGS. 7c and 7d. During lifting, generator beam ends 41–43 remain at ground level by virtue of their weight, and are forced toward their respective foundation points p1–p3 (FIGS. 7e and 7f) by the use of winches 46 or similar devices.

When the raising of the two-dimensional panel 35 begins, curvature(s) (convex or concave) will begin to be expressed in the surface of the two-dimensional panel 35 as shown in FIG. 7d. Care must be taken to assure that the curves, as they develop in regions o1–o4 between support beams m1–m5, are bending in the appropriate direction. The correct bending direction is convex (as viewed from outside the structure 39) in the case of regions o2 and o3 whose parent cone q2 is regular, and concave (as viewed from outside the structure 39 in FIG. 7e and 7f) in the case of regions o1' and o4' whose parent cones q1 and q3 are inverted. Correct curve direction is determined when cone regions are originally selected in the design of the structure (see Step One). Temporary restraining poles (an example of which is pole 48) or other devices can be propped against the shell at the beginning phase of raising the two-dimensional panel 35, as shown in FIG. 7d, to assure a convex bending. Concave bending usually requires no assistance since gravity automatically draws the inverted cone region into correct concave bending position.

The lifting of the ends of generator beams m2–m4 which converge at point 40 and the forcing of end points 41–43 toward their respective foundation points p1–p3 continues until the ends at point 40 reach the vertex position 40', and end points 41–43 reach their respective vertex positions 41'–43'. Thus the final positions of the vertices 40'–43' as determined in Step One are reached by the endpoints of beams m1–m5.

In FIGS. 7e and 7f region o1' meets and is attached to region o4' along a hyperbolic line 37' which theoretically extends from vertex 40' to vertex 49' (see FIG. 7a). This attachment is accomplished by the use of bolts, screws, adhesives, flashing, or other suitable attachment mechanism (not shown). In this example structure 39, an opening 50 in the vicinity of vertex 40' is shown. Such an opening 50 can be covered with clear plastic material or other transparent material to create a skylight.

Figure 8C:
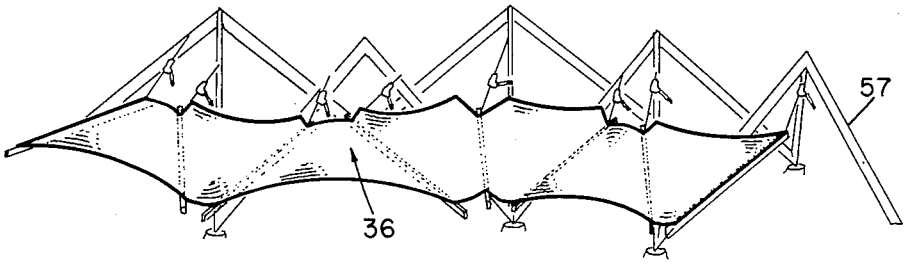
FIG. 8*c* is an oblique view of the building structure as shown in FIGS. 8*a*–8*b* shown with the multi-conic shell partially raised.
Figure 8D:
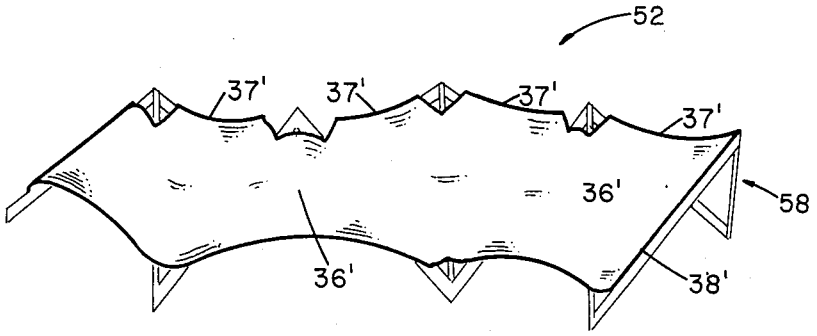
FIG. 8*d* is an oblique view of the building structure as shown in FIGS. 8*a*–8*c* shown with the multi-conic shell completely raised.

Method 2. As shown in oblique view in FIGS. 8a–8c a structure of support beams s1–s15 connecting the vertices of regular and inverted cones is constructed in their final position or state. For the sake of clarity, FIGS. 8b and 8c do not show the support beams numbered. Support beams s1–s15 are defined in a broad sense to include a wooden or metal beam, rod or other rigid connection or pole like structure. Thus a rigid framework made of support beams s1–s15 is constructed prior to the raising of the two-dimensional panels 36. This skeletal structure of support beams s1–s15 may, for example, approximate a series of adjacent tripods (tetrahedron supports) and in some instances four leg supports (as s10–s13). In instances where a partial tripod (two legs of a tripod as s14 and s15) is desired, as in a vault opening 58 as shown in FIG. 8d, a temporary support beam 57 can be provided to complete the third leg of the tripod (s14,s15, and 57 together). This temporary support 57 is removed after the multi-conic shells 36' and 171 (FIG. 8f) have been attached to the permanent support beams s1–s15.

Figure 8E:
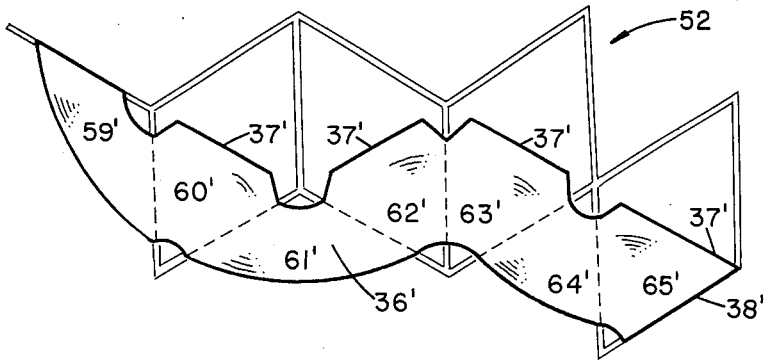
FIG. 8*e* is a plan view of the building structure as shown in FIGS. 8*a*–8*d* shown with the multi-conic shell completely raised.

The originally two-dimensional panel 36 is then pulled and flexed into appropriate position on the above structure of support beams s1–s15. FIG. 8c shows the position of panel 36 in an intermediate, partially flexed position. Temporary support beams t1–t8 (shown numbered in FIG. 8a) are attached to the two-dimensional panel 36 along or near lines which will correspond to the position of permanent support beams s1, s3, s4, s6, s9, s11, s13, and s15 respectively when the raising and bending process is complete to provide secure attachment of winches, come-alongs, and other pulling devices u1–u9. The winches, come-alongs and other pulling devices are also attached to, or near, the vertices v1–v5 of the structure of beams s1–s15. For the sake of clarity FIGS. 8b and 8c do not show winches, vertices and temporary support beams numbered. The pulling of the two-dimensional panel is accomplished by foreshortening of the cable lengths on the attached winches, come-alongs and other pulling devices u1–u9. When the pulling of the two-dimensional panel 36 begins, as shown in FIG. 8c, curvatures will begin in the surface of two-dimensional panel 36. The curvature is convex in region 59, 61, and 64 and concave in regions 60, 62, 63 and 65 as viewed from outside the completed structure 52 as shown in FIG. 8e. Care must be taken to assure that the curvature, once begun, is bending in the appropriate direction as indicated for each region of the multi-conic shell. This is accomplished as explained above by means of temporary poles or other devices. The pulling of the two-dimensional panel 36 continues as shown in FIG. 8c until the panel approximates the final orientation and becomes multi-conic shell 36' (as shown in oblique view in FIG. 8d and in plan view in FIGS. 8e and 8f). The multi-conic shell 36' is then attached to the structure of beams s1–s15 by the use of bolts, screws, adhesives or other suitable connection mechanism (not shown); and the temporary support beams t1–t8 used in the raising and bending process are removed.

Figure 8F:
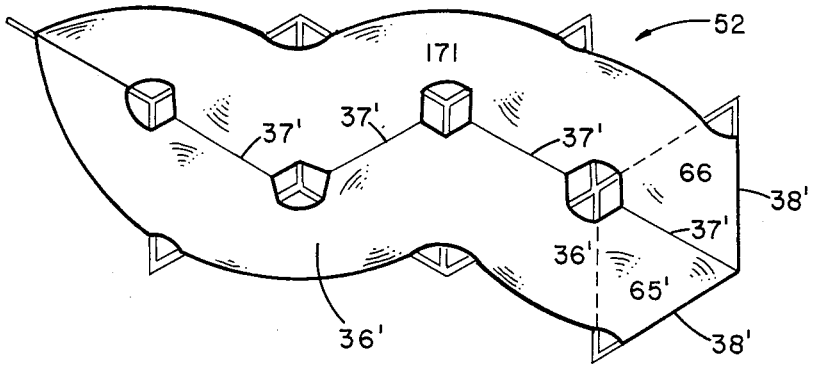
FIG. 8*f* is a plan view of the building structure as shown in FIGS. 8*a*–8*e* with an additional multi-conic shell attached to the opposite side of the tripod (tetrahedron) beam supports.
Figure 9A:
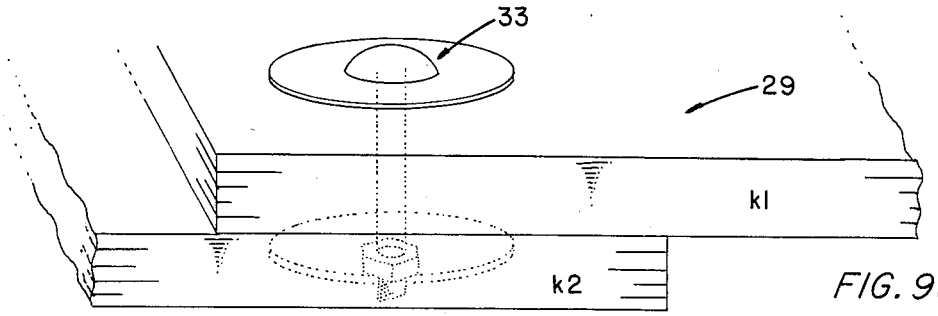
FIG. 9*a* is an oblique view of two panels of plywood joined by side lapping and connected by a carriage bolt and fender washers.
Figure 9B:
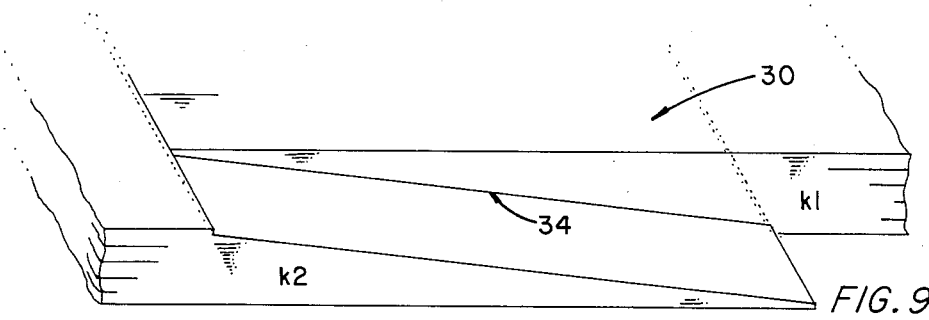
FIG. 9*b* is an oblique view of two panels of plywood joined by a scarf lap and connected with glue.
Figure 9C:
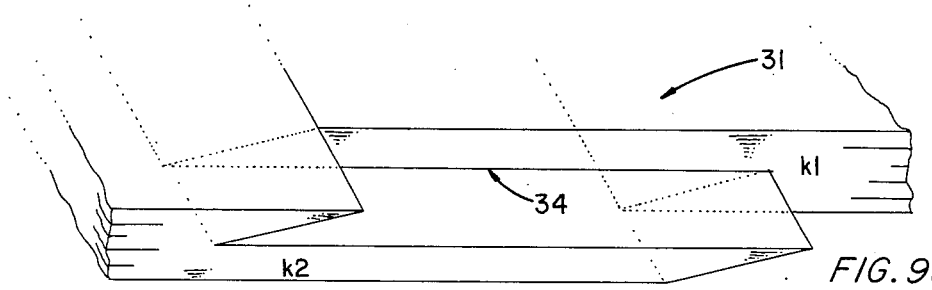
FIG. 9*c* is an oblique view of two panels of plywood joined by a mitered scarf lap and connected with glue.
Figure 9D:
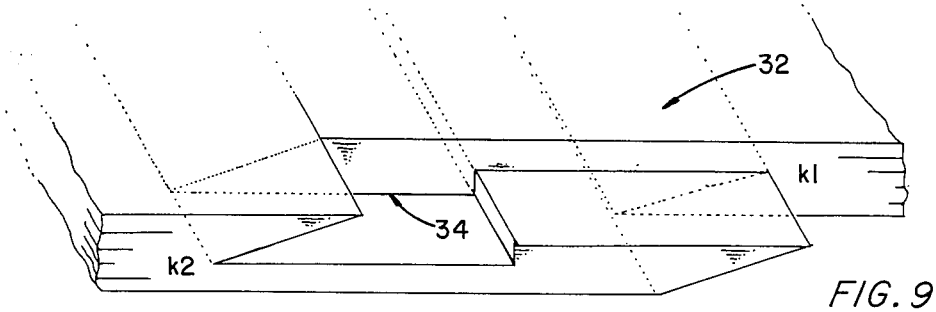
FIG. 9*d* is an oblique view of two panels of plywood joined by a self-locking mitered scarf lap and connected with glue.

Using a similar process, multi-conic shell 171 shown in FIG. 8f is also raised and curved to attach to the support beam structure s1–s15.

STEP FOUR. Adjacent cone regions (e.g. 65' and 66 as shown in FIG. 8f) corresponding to similarly oriented parent cones (in this case two inverted parent cones) are connected along curved lines 37' (an identical connection is shown along curved line 37' in FIG. 7e and 7f) by use of a strap connection, weld bead, butt joint connection or other suitable edge connection.

At the completion of Step Four the Building structure is self supporting and represents a completed structure. Any temporary support beams are now removed (such as temporary tripod support beam 57 in FIG. 8c).

STEP FIVE. Vertical walls (not shown in FIGS. 7b–7f or 8d–8f, similar to walls i1–i3 shown in FIG. 1) can be built using conventional 16 inch on-center stud wall construction or other wall panel techniques to connect the perimeter edge of the multi-conic shell to a horizontal floor or foundation.

Note that Steps Four and Five are optional and that Steps Three and Four can be used to connect the multi-conic shell structure to a wall of an existing structure or other existing structure so that the connection of curved lines in Step Four are unnecessary.

Theoretical Array of Regular and Inverted Cones

Significant strength in supporting structural loads is realized when multi-conic shells correspond to an array of intersecting regular (opening downward) and inverted (opening upward) theoretical cones. The nature of this array, and structures built corresponding to it will now be discussed in detail.

Figure 10:
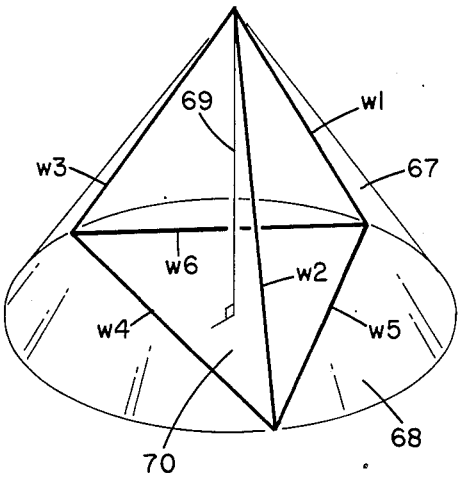
FIG. 10 is an oblique view of a right circular cone with a single internal tetrahedron.

Right circular cones exhibit stability by virtue of redundant tetrahedrons being manifest in the cone surface and cone base. FIG. 10 shows a single tetrahedron 70 the edges w1–w3 of which lie in the surface of the right circular cone 67 and the edges w4–w6 of which lie in base 68 of right circular cone 67. Tetrahedron 70 can be rotated around axis 69, and in every position possible during such a rotation, edges w1–w3 will remain in the surface of cone 67, and edges w4–w6 will remain in the cone base 68. The tetrahedron 70 exhibits substantial stability, as is well known in the fields of engineering, chemistry, and physics. A cone, therefore, exhibits similar stability by virtue of containing a multiplicity of tetrahedron structures which manifest throughout the surface and base of the cone.

By extension, a multi-conic shell, being at all points congruent with the surface of a cone, may exhibit substantial stability if tetrahedron structures are found to manifest throughout the shell and the ground plane or reference plane to which the multi-conic shell may be attached.

Building on the above concept, multi-conic shells which are built to correspond to an array of intersecting regular (opening downward) and inverted (opening upward) theoretical right circular cones exhibit a multiplicity of tetrahedron structures which manifest throughout the shell and the ground plane or attachment plane to which the multi-conic shell is connected thus providing significant structural stability and a capacity to support various loads with a minimum of materials.

Figure 3:
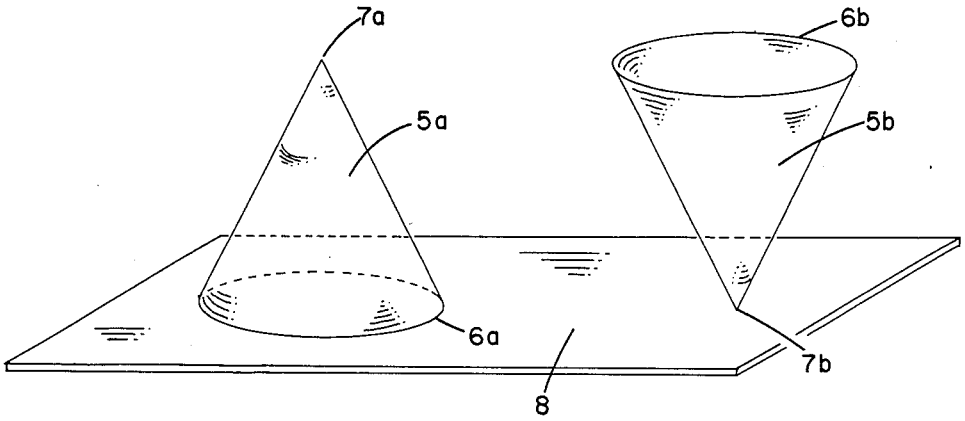
FIG. 3 is an oblique view of a regular cone and an inverted cone.
Figure 4:
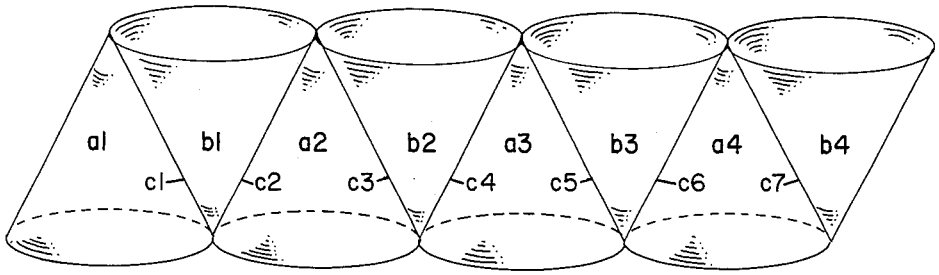
FIG. 4 is an oblique view of eight alternately oriented regular and inverted cones.
Figure 11A:
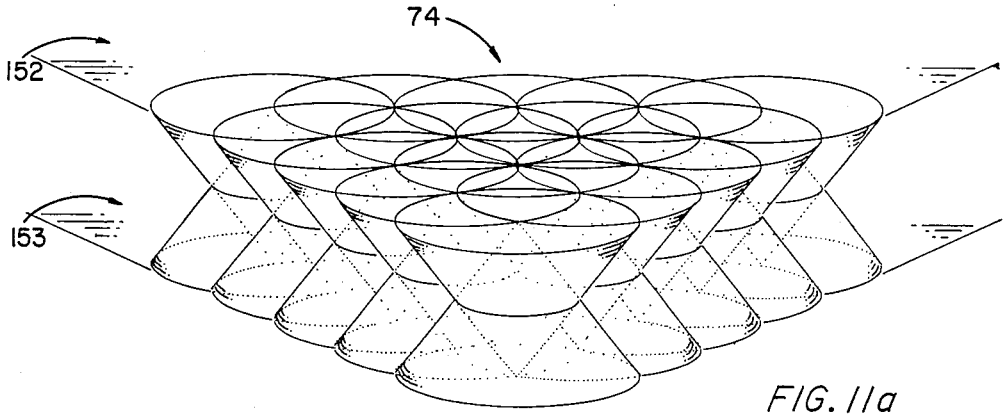
FIG. 11*a* is an oblique view of a portion of the theoretical array of intersecting regular and inverted cones including fifteen regular and fifteen inverted cones.
Figures 1, 11B:
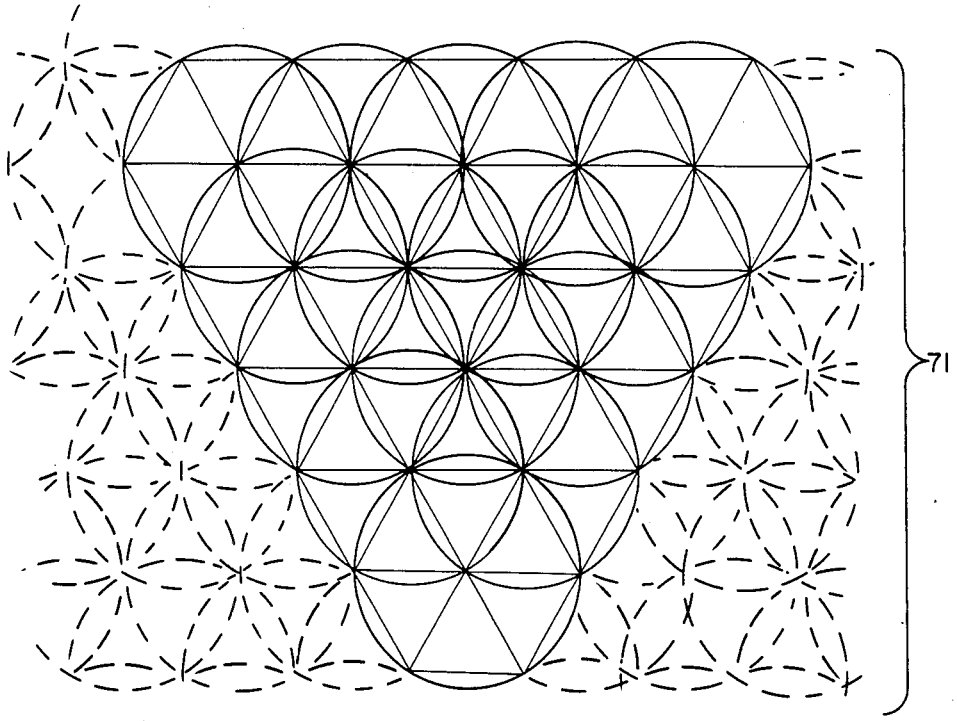
Figures 2, 11B:
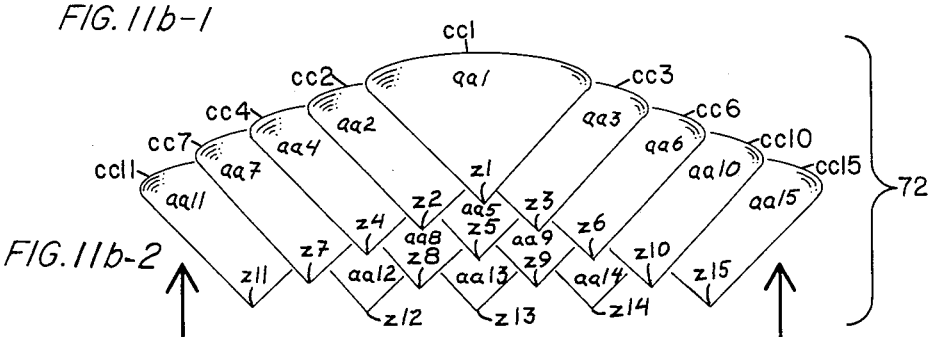
Figures 3, 11B:
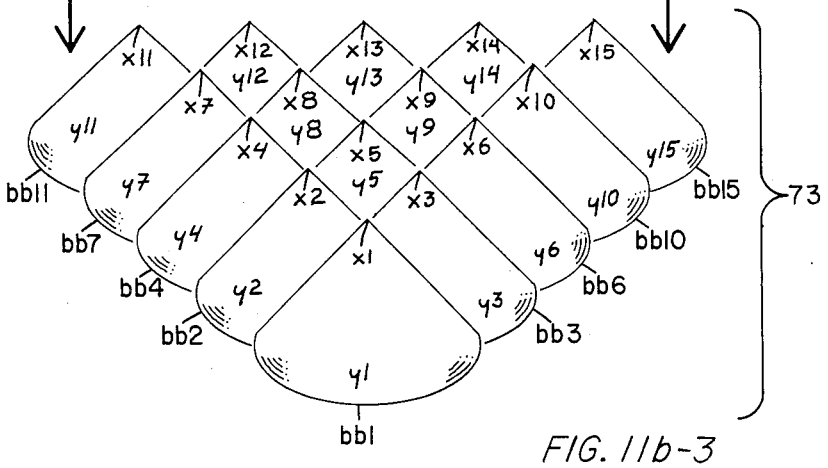

A portion of such a theoretical array is shown in FIGS. 11*a* and 11*b*-1 thru 11*b*-3. Pattern 71 in FIG. 11*b*-1 shows an equilateral triangular array with a superimposed circular array. Pattern 71 is a plan view of a portion of the theoretical array containing 15 regular and 15 inverted cones. The vertices of pattern 71 correspond to the vertices x1–x15 (exploded view 73) of regular cones y1–y15 and the vertices z1–z15 (exploded view 72) of inverted cones aa1–aa15. Pattern 71 further shows circles which correspond to the bases of regular cones y1–y15 and aal–aa15. FIG. 11*a* shows an oblique view of this portion of the array. The regular cones (exploded view 73) and inverted cones (exploded view 72) are shown in FIGS. 11*b*-2 and 11*b*-3 for clarity.

The theoretical array 71 (FIG. 11*b*-1) and 74 (FIG. 11*a*) corresponds to regular and inverted right circular cones arranged on an equilateral triangular grid. Regular cones y1–y15 are arranged so that their vertices x1–x15 lie in a common plane 152. The axis of each regular cone is normal to common plane 152, and the vertices x1–x15 of all regular cones form an equilateral tri,angular pattern 71 of constant dimension as shown in FIG. 11*b*-1. Each vertex has a constant distance from each neighboring vertex. Likewise, the inverted cones aa1–aa15 are arranged so that their vertices z1–z15 lie in a common plane 153 (FIG. 11*a*) which is parallel to and below (and therefore distinct from) the common plane 152 defined by the regular cone vertices x1–x15. The axis of each inverted cone is normal to the common plane containing the vertices z1–z15 of the inverted cones and the vertices z1–z15 form an equilateral triangular pattern of constant dimension identical to the equilateral triangular pattern of the regular cones. The arrays of both the regular and inverted theoretical cones are defined so that when the bases of the inverted cones aa1–aa15 (view 72) are orthogonally projected on to the plane 153 (FIG. 11*a*) containing the vertices z1–z15 and the vertices of the regular cones y1–y15 (view 73) are projected on to this same plane, the pattern of projected vertices and bases for the regular cones y1–y15 is identical to the pattern of projected vertices and bases for the inverted cones aa1–aa15.

Figure 12A:
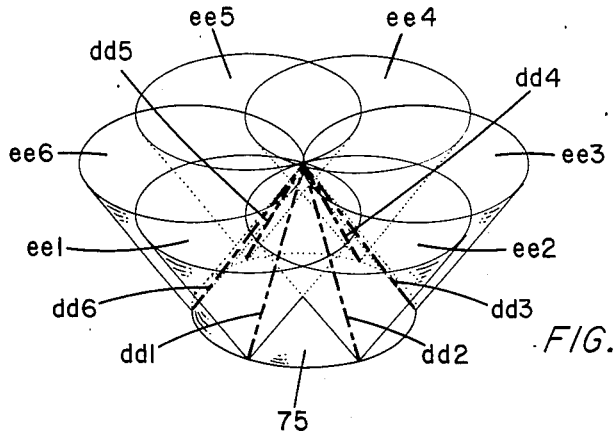
FIG. 12*a* is an oblique view of a single regular cone in the theoretical array surrounded by six adjacent inverted cones and showing the six primary generators tangent to the regular cone and sequentially tangent to the six inverted cones.
Figure 12B:
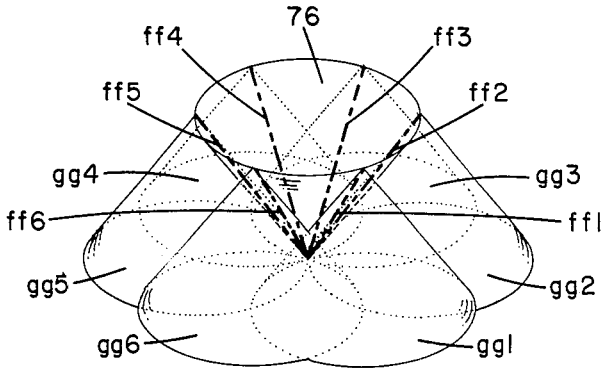
FIG. 12*b* is an oblique view of a single inverted cone in the theoretical array surrounded by six adjacent regular cones and showing the six primary generators tangent to the inverted cone andsequentially tangent to the six regular cones.

The regular and inverted theoretical cone arrays are further defined so that the circular base perimeter bb1–bb15 as shown in FIG. 11*b*-3 (bb5, bb8–bb9, and bb12–bb14 are not shown in FIG. 11*b*-3) of each regular cone intersects the vertices of six adjacent inverted cones, and the circular base perimeters of these six adjacent inverted cones intersect at the vertex of their mutually adjacent regular cone (see also FIG. 12*a*). Likewise, the circular base perimeter cc1–cc15 (cc5, cc8–cc9, and cc12–cc14 are not shown in FIG. 11*b*-3) of each inverted cone intersects the vertices of six adjacent regular cones, and the circular base perimeters of these six adjacent regular cones intersect at the vertex of their mutually adjacent inverted cone (see also FIG. 12*b*).

In a theoretical array so defined, each regular cone 75 (FIG. 12*a*) is tangent along primary generators dd1–dd6 with six adjacent inverted cones ee1–ee6 and likewise, each inverted cone 76 (FIG. 12*b*) is tangent along primary generators ffl–ff6 with six adjacent regular cones gg1–gg6.

In such an array, cones of similar orientation can intersect one another in two ways depending on their proximity. As shown in views 78 and 79 in FIGS. 13*a*-1 and 13*a*-2 two cones 77*a* and 77*b* of similar orientation are "immediately adjacent" if the base of one cone intersects a 120 degree angular portion of the other cone's base. In the case of immediately adjacent cones, the base 80*a* of cone 77*a* intersects the axis 81*b* of the cone 77*b*, and the base 80*b* of cone 77*b* intersects the axis 81*a* of cone 77*a*; and the surfaces of both similarly oriented and immediately adjacent cones 77*a* and 77*b* intersect along a hyperbolic curve 82 which extends over a 120 degree portion of the base 80*a* and 80*b* of both cones 77*a* and 77*b* respectively.

Figures 1, 13A:
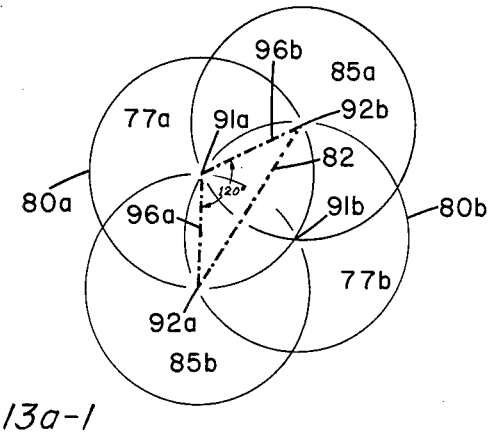
Figures 2, 13A:
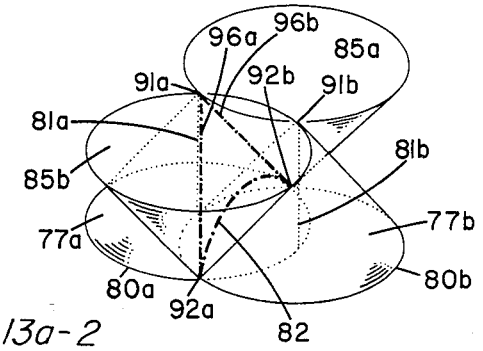
Figures 3, 13A:
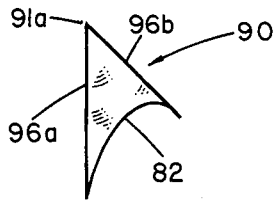
Figures 1, 13B:
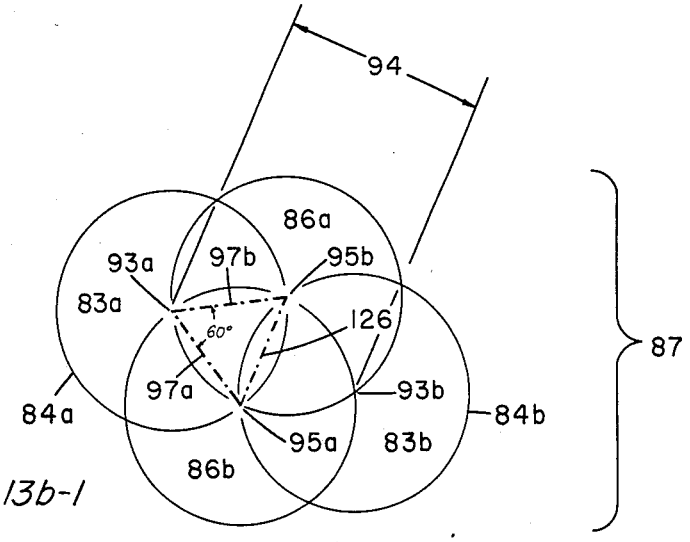
Figures 2, 13B:
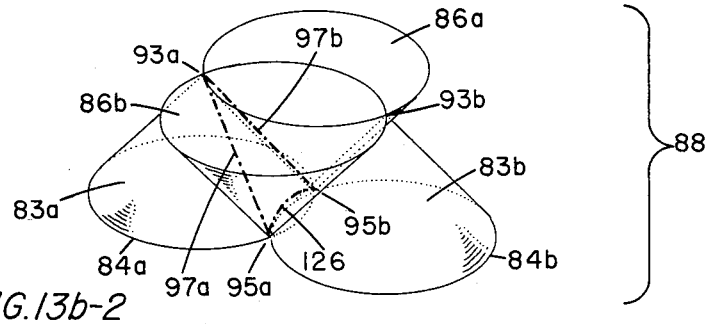
Figures 3, 13B:
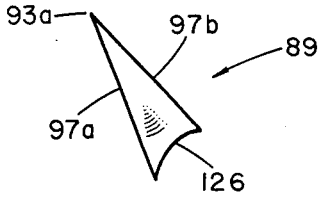

As shown in FIGS. 13*b*-1 and 13*b*-2, two cones of similar orientation 83*a* and 83*b* are "remotely adjacent" if the base 84*a* of cone 83*a* intersects a 60 degree angular portion of the base 84*b* of the other cone 83*b*. In such a case, both remotely adjacent cones 83*a* and 83b intersect along a hyperbolic curve 126 which extends over a 60 degree portion of the bases 84*a* and 84*b* of cones 83*a* and 83*b* respectively. Immediately adjacent cones (e.g. 77*a* and 77*b*) or remotely adjacent cones (e.g. 83*a* and 83*b*) of similar orientation (regular or inverted) will intersect one another along a hyperbolic curve which begins and ends at the vertices of two oppositely oriented and remotely adjacent or immediately adjacent cones respectively (e.g. remotely adjacent cones 85*a* and 85*b* of FIGS. 13*a*-1 and 13*a*-2 or immediately adjacent cones 86a and 86b of FIGS. 13b-1 and 13b-2 respectively).

FIGS. 13a-1 and 13a-2 show the case where two immediately adjacent cones 77a and 77b of similar orientation intersect. Both of these cones have their vertices 91a and 91b directly over points on the base circle of the other. In this case the hyperbolic curve 82 begins and ends along the base circle at points 92a and 92b separated by 120 degrees of arc measured from the center 91a in plan view 78 of the base circle 80a. FIGS. 13b-1 and 13b-2 show the case where two remotely adjacent cones 83a and 83b of similar orientation intersect. Plan view 87 and oblique view 88 are shown in FIGS. 13b-1 and 13b-2 respectively. Both of these cones have their vertices 93a and 93b separated by a distance 94 of twice the cosine of 30 degrees times the radius of the base circle 84a (approximately 1.7321r where r=radius of base circle 84a). In this case the hyperbolic curve 126 begins and ends along the base circle 84a at points 95a and 95b separated by 60 degrees of arc measured from the center 93a in plan view 87 of the base circle 84a.

"Cone segments" are now defined which correspond to the above theoretical array of regular and inverted cones. A cone segment is a portion of a parent cone which lies between a first and a second primary generator (the first being distinct from the second) and which includes in its boundary a segment of the first primary generator and a segment of the second primary generator. By definition the parent cone is the entire conical surface of which the cone segment is a subset. Cone segments can be joined at primary generator segments to other cone segments to form a continuous multi-conic surface which itself is a simple curved surface. The border of a cone segment may also include the vertex of its parent cone and may include the hyperbolic curve which is defined by intersecting immediately adjacent or remotely adjacent similarly oriented cones in the theoretical array as previously discussed.

Two special cone segments which correspond to specific portions of the cones in the theoretical array are of particular importance and are shown in their general form in FIGS. 13a'thru 13a-3 and 13b-1 thru 13b-3. One special cone segment is called a "tri-part", and is a portion of a regular cone (for example tri-part 90 of FIG. 13a-3) or inverted cone (not shown) where the two bordering primary generators (e.g. 96a and 96b), when projected on to the base 80a of the parent cone 77a, subtend a 120 degree portion of the base 80a. The second special cone segment is called a "hex-part" and is a portion of a regular cone (for example hex-part 89 of FIG. 13b-3) or inverted cone (not shown) where the two bordering generator lines (e.g. 97a and 97b), when projected on to the base 84a of the parent cone 83a, subtend a 60 degree portion of the base 84a.

Figures 1, 14A:
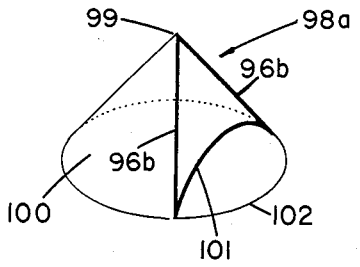
Figures 2, 14A:
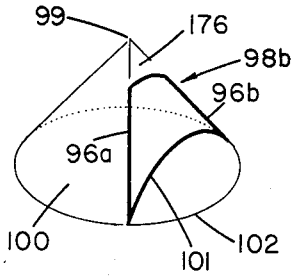
Figures 3, 14A:
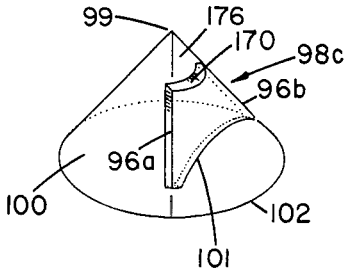
Figures 4, 14A:
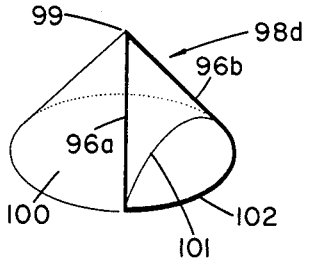
Figures 5, 14A:
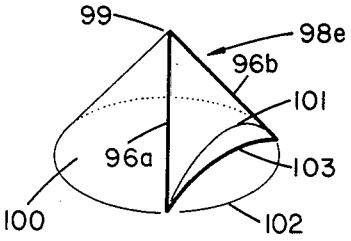
Figures 6, 14A:
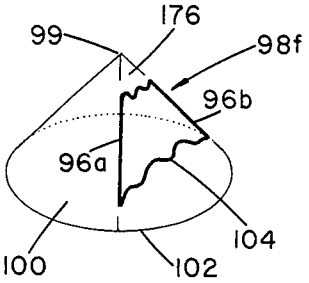

Given the above definition of a tri-part, the border extending between the regions of the two bordering primary generators may be described in several ways. FIGS. 14a-1 thru 14a-6 show examples of various tri-part borders 98a–98f which are consistent with the definition of a tri-part. The border of a tri-part may include the vertex 99 of the parent cone 100 as in tri-part 98a, 98d and 98e, or may leave a void 176 in the vicinity of the vertex 99 to enable a skylight window as in tri-part 98b, 98c and 98f (as in the case of a building structure such as skylights 24, 25 and 26 in FIG. 1) or to enable a large gluing surface 170 as in tri-part 98c (as in the case of a structural panel as is discussed below). A tri-part border may include a hyperbolic curve (for example 101) defined by the intersection of two immediately adjacent similarly oriented cones (not shown in FIGS. 14a-1 thru 14a-6, but shown in FIGS. 13a-1 and 13a-2) as in tri-part 98a–98c. A tri-part may extend beyond hyperbolic curve 101 and extend to the base 102 of the parent cone 100 as in tri-part 98d. A tri-part (for example tri-part 98e) may have a border 103 that extends between the hyperbolic curve 101 and the parent cone base 102. A tri-part thus extended is called an "extended tri-part" and may enable maximum use of rectangular building materials. Finally, a tri-part (e.g. 98f) may have a border (for example 104) that in any way joins the two primary generators 96a and 96b provided the border lies in the parent cone 100 (i.e. on the surface of the cone) and remains between the two primary generators 96a and 96b as shown in tri-part 98f. A tri-part may have a parent cone that is regular and thus is a "regular tri-part" as examples 98a–98f in FIGS. 14a-1 thru 14a-6, or a tri-part may have a parent cone that is inverted and thus is an "inverted tri-part" (not shown).

Given the above definition of a hex-part, the border extending between the regions of the two bordering primary generators may be described in several ways. FIGS. 14b-1 thru 14a-6 show examples of various hex-part borders 105a–105f which are consistent with the definition of a hex-part. The border of a hex-part may include the vertex 106 of the parent cone 107 as in hex-part 105a, 105d and 105e, or may leave a void 110 in the vicinity of the vertex 106 to enable a skylight window as in hex-part 105b, 105c and 105f, (as in the case of a building structure such as skylights 24, 25 and 26 in FIG. 1) or to enable a large gluing surface 111 as in hex-part 105c (as in the case of a structural panel as discussed below). A hex-part border may include a hyperbolic curve (for example 108) defined by the intersection of two remotely adjacent, similarly oriented cones (not shown in FIGS. 14b-1 thru 14b-6 but shown in FIGS. 13b-1 and 13b-2) as in hex-part 105a–105c. A hex-part may extend beyond hyperbolic curve 108 and extend to the base 109 of the parent cone 107 as in hex-part 105d. A hex-part (for example hex-part 105e) may have a border 112 that extends between the hyperbolic curve 108 and the parent cone base 109. A hex-part thus extended is called an "extended hex-part" and may enable maximum use of rectangular building materials. Finally, a hex-part (e.g. 105f) may have a border (for example 113) that in any way joins the two geerator lines 97a and 97b provided the border lies in the parent cone 107 (i.e. on the surface of the cone) and remains between the two primary generators 97a and 97b as shown in hex-part 105f. A hex-part may have a parent cone that is regular and thus is a "regular hex-part", as examples 105a–105f in FIGS. 14b-1 thru 14b-6, or a hex-part may have a parent cone that is inverted and thus is an "inverted hex-part" (not shown).

Figure 15A:
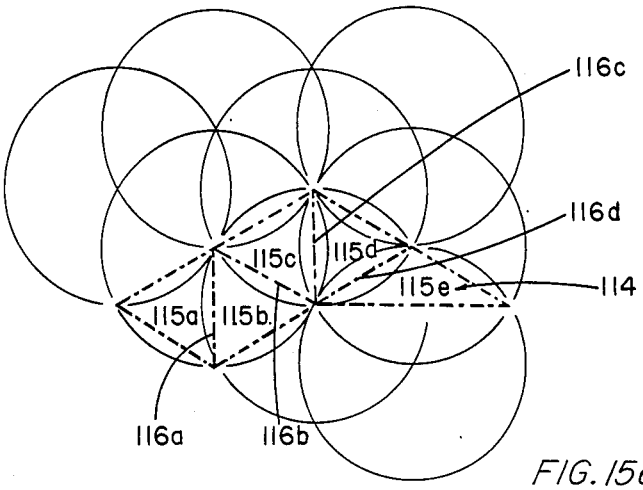
FIG. 15a is a plan view of the bases of eight parent cones and three inverted hex-parts, one regular hex-part and one regular tri-part connected at primary generators.
Figure 15B:
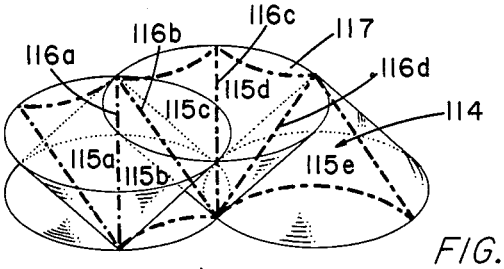
FIG. 15b is an oblique view of the three inverted hex-parts, one regular hex-part and one regular tri-part as shown in FIG. 15a with the parent cone of each cone segment.
Figure 15C:
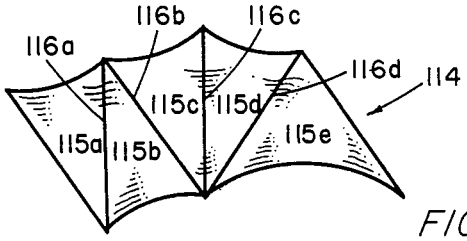
FIG. 15c is an oblique view of the cone segments shown in FIGS. 15a–15b without parent cones.
Figure 15D:
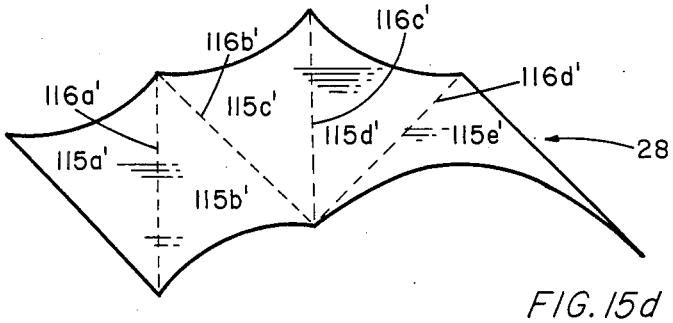
FIG. 15d is a plan view of the cone segments shown in FIGS. 15a–15c connected as one panel and shown in their uncurved and flat configuration.

The special cone segments described above which are derived from both regular and inverted cones in the theoretical array can be joined at a mutually bordering tangent line (primary generator) and/or at a mutually hyperbolic intersection corresponding to the intersection of adjacent and similarly oriented theoretical cones to create an unlimited variety of multi-conic surface patterns for use as a model for building structures and structural panels. In FIGS. 15a–15d an example of a multi-conic surface 114 consisting of five joined cone segments 115a–115e is illustrated. Inverted hex-part 115*a* is joined along primary generator 116*a* to regular hex-part 115*b*. Regular hex-part 115*b* is likewise joined at primary generator 116*b* to inverted hex-part 115*c*. Inverted hex-part 115*c* joins inverted hex-part 115*d* at primary generator 116*c* although these two segments share the same parent cone 117. Inverted hex-part 115*d* joins regular tri-part 115*e* at primary generator 116*d*. Cone segments 115*a*–115*e* form multi-conic surface 114 as shown in FIG. 15*c*. This surface, when uncurved and made to lay flat corresponds to flat surface 28 as shown in FIG. 15*d*. Cone segments 115*a*–115*e* correspond to flat and uncurved cone segments 115*a*'–115*e*' as shown in FIG. 15*d*. Primary generators 116*a*–116*d* correspond to lines 116*a*'–116*d*' in FIG. 15*d*.

As has previously been described, one method of forming a multi-conic shell involves the creation of flat (two-dimensional) panels which are subsequently flexed and forced into a continuous simple curved surface congruent to a multi-conic surface. For a multi-conic surface composed of tri-parts and hex-parts the perimeter dimensions of the tri-part and hex-part when first assembled in their flat (two-dimensional) configurations are therefore of special concern when undertaking the construction of a multi-conic shell corresponding to the theoretical array.

Figure 16:
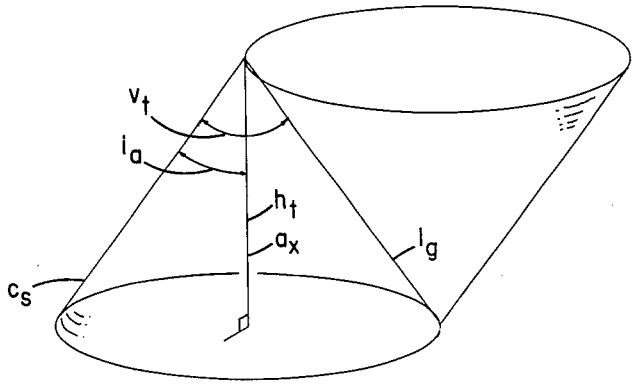
FIG. 16 is an oblique view of one regular right circular cone and one inverted right circular cone with vertex angle, height, axis and primary generator delineated.

As shown in FIG. 16 when designing a multi-conic shell that corresponds to the theoretical array the designer must determine the height $h_t$ of the multi-conic shell. He also must determine the vertex angle $v_t$ of the cones in the theoretical array (twice the interior angle $i_a$ between the cone axis $a_x$ and the cone surface $c_s$ from the vertex). Both the height $h_t$ and vertex angle $v_t$ are design considerations and are determined by aesthetic and/or space requirements. From the height $h_t$ and vertex angle $v_t$ the length $l_g$ of all primary generators (distance from vertex of a regular cone to the vertex of a tangent inverted cone) can be calculated as follows:

$$l_g = h_t / (\cos(v_t/2))$$

Figure 17:
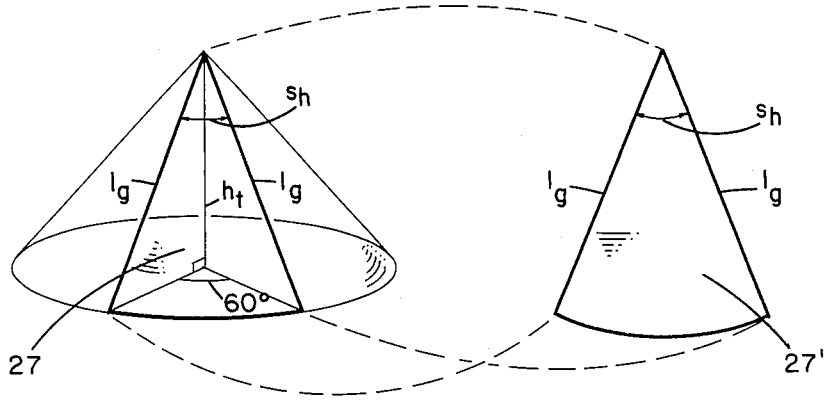
FIG. 17 is an oblique view of a regular right circular cone with hex-part and base angle increment, the hex-part is also shown in its uncurved and flat configuration.

= length of primary generator connecting the vertex of a regular cone to the vertex of a tangent and oppositely oriented cone.

where:

$h_t$=desired vertical height of cones in array $v_t$=vertex angle of all cones in array Given the vertex angle $v_t$ as shown in FIG. 16 of all cones in the array, the surface angle $s_h$ (FIG. 17) between generator lines for a hex-part 27 and the surface angle $s_t$ between generator lines for a tri-part (not shown) when unflexed and in their respective flat configuration (e.g. hex-part 27' in FIG. 17) can be calculated as follows:

$$s_h = 60\,(\sin(v_t/2)) \text{ in degrees}$$

= angular separation between two primary generators for a hex-part in its flat configuration $$s_t = 120\,(\sin(v_t/2)) \text{ in degrees}$$

= angular separation between two primary generators for a tri-part in its flat configuration Thus the surface angles $s_h$ and $s_t$ between primary generators of hex-part and tri-part perimeter are determined.

The perimeter dimensions on the side of the hex-part or tri-part opposite from the vertex can be determined at the discretion of the designer using the general methodology previously presented (See Method of Forming a Building Structure, Step One). If the designer determines that a hex-part or tri-part does not include the vertex of the parent cone (i.e. to accommodate a skylight window opening in the case of a building structure or to increase the gluing surface in the manufacture of a structural panel), then the perimeter measurements on the vertex side of the hex-part or tri-part are likewise determined at the discretion of the designer using the general methodology previously presented.

However, in many instances using the theoretical array, hex-parts and tri-parts will attach to other hex-parts and tri-parts along a hyperbolic curve corresponding to the intersection of immediately adjacent and/or remotely adjacent similarly oriented cones as previously discussed. Determining the position and dimensions of the hyperbolic curves for both the hex-part and tri-part when in their flat configuration is therefore of great importance. In such cases, the marking and subsequent cutting of the flat panels should be along a specific curve which, when the flat panels are flexed and thus curved, becomes a hyperbolic curve. This curve can be determined as follows:

STEP ONE: The Designer selects the vertex angle $v_t$ and height $h_t$ (FIG. 16) of the cones in the theoretical array of cones and determines the length of primary generators $l_g$ (distance between the vertices of adjacent regular and inverted cones) in the theoretical array of cones. All cones in the array, both inverted and regular, have identical vertex angles $v_t$ and identical primary generator lengths $l_g$.

Figure 18:
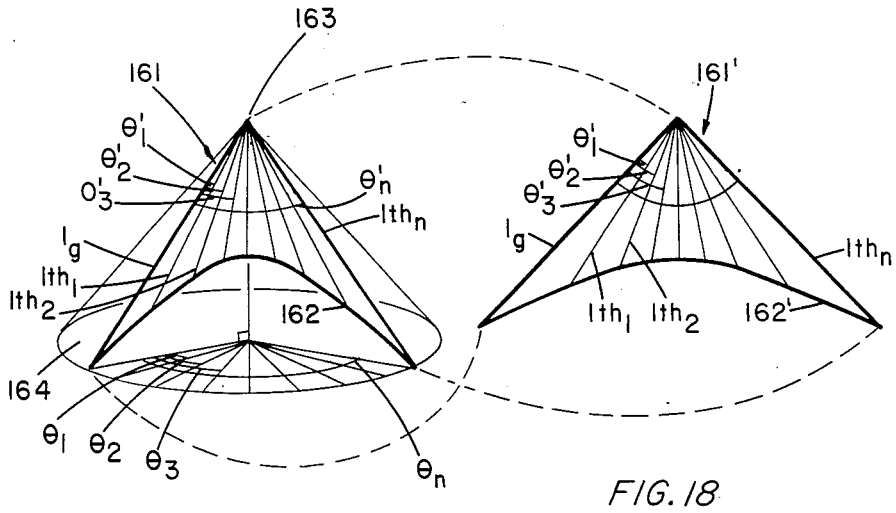
FIG. 18 is an oblique view of a regular cone with tri-part and projected base angle divided into increments $\theta_n'$ and $\theta_n$ respectively, the tri-part is also shown in its uncurved and flat configuration.

STEP TWO: Solve for the lengths $lth_n$ (as shown for a tri-part in FIG. 18) between the vertex 163 of the parent cone and the hyperbolic curve line 162 at base angle increments $\theta_n$. For a hex-part (not shown in FIG. 18) (60 degree base angle) and tri-part 161 (120 degree base angle) increments of 3.75 degrees are recommended as providing sufficient accuracy in the construction of a building structure although smaller increments may be used if greater accuracy is desired. In general, $$lth_n = l_g[\cos(\beta/2)]/[\cos((\beta/2) - \theta_n)]$$

= length from vertex to hyperbolic curve line corresponding to base angle increment $\theta_n$ where:

$l_g$=length of primary generator bordering the cone segment $\beta$=vertex angle of tri-part (or hex-part) when projected to the cone base (60 degrees for hex-part, 120 degrees for tri-part)

$\theta$=n(angle of increment) (3.75 degree increment recommended for building structures)

Increment n and repeat calculation until 16 or 33 lengths $lth_n$ have been calculated for the hex-part and tri-part respectively (assuming a 3.75 degree increment). The lengths $lth_n$ are then the appropriate surface lengths in the planar configuration when the hex-part or tri-part is made flat; however the surface vertex angle $\theta_n'$ for each length $lth_n$ must be calculated from the base angle $\theta_n$.

STEP THREE: Solve for the vertex angle $\theta_n'$ measured on the surface of the cone from the base angle $\theta_n$. Since the cone segment is a developable surface, the vertex surface angles $\theta_n'$ will remain unchanged when the cone segment (e.g. 161) is in a flat two-dimensional configuration (e.g. 161').

$$\theta_n' = \theta_n (\sin(v_t/2))$$

= vertex angle measured on the surface of the cone and corresponding to base angle $\theta_n$ (also correct when the cone segment is in the flat two-dimensional configuration)

where:

$v_t$=vertex angle of all cones in the array

The calculations have been performed for a theoretical array where all cones have a vertex angle $v_t$ of 97.1808 degrees as shown below. The calculations have been performed for both hex-parts and tri-parts. A primary generator length $l_g$ of 1.0 has been used in the calculations which follow:

LENGTHS FROM VERTEX TO HYPERBOLIC CURVE LINE CALCULATED AT 3.75 DEGREE INCREMENTS

| base angle $\theta_n$ | vertex surface angle $\theta_n'$ (also correct for uncurved and therefore flat surface) where $v_t$ = 97.1808° | length $lth_n$ on surface from parent cone vertex |
|---|---|---|
| | HEX-PART | |
| 0.00 | 0.00 | 1.0000 ($l_g$) |
| 3.75 | 2.81 | .9656 |
| 7.50 | 5.62 | .9373 |
| 11.25 | 8.43 | .9145 |
| 15.00 | 11.25 | .8965 |
| 18.75 | 14.06 | .8829 |
| 22.50 | 16.88 | .8735 |
| 26.25 | 19.69 | .8679 |
| 30.00 | 22.50 | .8660 |
| 33.75 | 25.31 | .8679 |
| 37.50 | 28.13 | .8735 |
| 41.25 | 30.94 | .8829 |
| 45.00 | 33.75 | .8965 |
| 48.75 | 36.56 | .9145 |
| 52.50 | 39.38 | .9373 |
| 56.25 | 42.19 | .9656 |
| 60.00 | 45.00 | 1.0000 ($l_g$) |
| | TRI-PART | |
| 0.00 | 0.00 | 1.0000 ($l_g$) |
| 3.75 | 2.81 | .8910 |
| 7.50 | 5.62 | .8213 |
| 11.25 | 8.43 | .7583 |
| 15.00 | 11.25 | .7071 |
| 18.75 | 14.06 | .6650 |
| 22.50 | 16.88 | .6302 |
| 26.25 | 19.69 | .6013 |
| 30.00 | 22.50 | .5776 |
| 33.75 | 25.31 | .5575 |
| 37.50 | 28.13 | .5412 |
| 41.25 | 30.94 | .5280 |
| 45.00 | 33.75 | .5176 |
| 48.75 | 36.56 | .5098 |
| 52.50 | 39.38 | .5043 |
| 56.25 | 42.19 | .5011 |
| 60.00 | 45.00 | .5000 |
| 63.75 | 47.81 | .5011 |
| 67.50 | 50.62 | .5043 |
| 71.25 | 53.44 | .5098 |
| 75.00 | 56.25 | .5176 |
| 78.75 | 59.06 | .5280 |

-continued

LENGTHS FROM VERTEX TO HYPERBOLIC CURVE LINE CALCULATED AT 3.75 DEGREE INCREMENTS

| base angle $\theta_n$ | vertex surface angle $\theta_n'$ (also correct for uncurved and therefore flat surface) where $v_t$ = 97.1808° | length $lth_n$ on surface from parent cone vertex |
|---|---|---|
| 82.50 | 61.88 | .5412 |
| 86.25 | 64.69 | .5575 |
| 90.00 | 67.50 | .5776 |
| 93.75 | 70.31 | .6013 |
| 97.50 | 73.13 | .6302 |
| 101.25 | 75.94 | .6650 |
| 105.00 | 78.75 | .7071 |
| 108.75 | 81.56 | .7583 |
| 112.50 | 84.38 | .8213 |
| 116.25 | 87.19 | .8910 |
| 120.00 | 90.00 | 1.0000 ($l_g$) |

STEP FIVE: Scribe or otherwise mark each alculated length $lth_n$ at corresponding angular increments ($\theta_n'$) on the surface of the flat (two-dimensional) panel. Draw a smooth line connecting all points so marked. Cut along smooth line.

Example of Building Structure Built to Correspond to the Theoretical Array

FIGS. 19*a* thru 19*c*-11 depict a roof-wall portion of a building structure which can be constructed to correspond to the theoretical array. FIG. 19*a* is a plan view of a structure that can be derived from the theoretical array and built according to the teachings of the invention. FIG. 19*b* is an oblique view of the same structure with shadows projected vertically downward from the, edge of the roof/wall. As can be seen in the plan view of FIGS. 19*c*-1 thru 19*c*-11 the structure is made of connected cone segments which are identified as regular tri-parts 117, inverted tri-parts 118, regular tri-parts 119 extended beyond the hyperbolic curve perimeter, regular hex-parts 120, inverted hex-parts 121, and regular hex-parts 122 extended beyond the hyperbolic curve perimeter. No extended inverted hex-parts or extended inverted tri-parts are shown as part of this example structure. In FIG. 19*b* opening skylights 123 are shown for the upper corner of an inverted tri-part 118 and the upper corner of a regular tri-part 117. FIG. 19*c* shows a plan view of the same building structure 180 as in FIG. 19*b* with each component flat panel j1–j10 shown in its respective two-dimensional orientation and with the appropriate perimeter j1*a*–j10*a* dimension to scale as they would appear prior to being flexed and thus curved into a shape corresponding to a multi-conic shell of the depicted roof/wall structure as shown in FIGS. 19*a* thru 19*c*-11.

FIG. 19*c*-11 shows the perimeter 124 of the resulting roof/wall structure and the connections 125*a* and 125*b* between each multi-conic shell j1'–j10' where they connect along hyperbolic lines of parent cone intersections (straight lines in plan view). Hyperbolic intersections 125*a* and 125*b* correspond to the intersection of cone segments belonging to adjacent multi-conic shells. Hyperbolic intersections corresponding to the intersection of remotely adjacent parent cones are labeled 125*a*. Hyperbolic intersections corresponding to the intersection of immediately adjacent parent cones are labeled 125*b*. Each multi-conic shell component j1'–j10' is thus outlined as it appears in plan view when the structure is assembled. Each multi-conic shell component j1–j10 is also shown in its uncurved and flat configuration (flat panels are shown corresponding to multi-conic shell components by double headed arrows). Each cone segment, either regular tri-part 117', inverted tri-part 18', regular tri-parts 119' extended beyond the hyperbolic curve perimeter, regular hex-parts 120', inverted hex-parts 121', or regular hex-parts 122' extended beyond the hyperbolic curve perimeter are shown and numbered as part of the flat two-dimensional multi-conic shell components j1–j10.

The multi-conic shell structure shown in FIGS. 19*a*–19*c*-11 has been designed with all parent cone vertex angles in the theoretical array equal to 97.1808 degrees. This vertex angle allows uncurved flat panels to approximate 90 degree surface vertex angles for tri-part components and 45 degree surface vertex angles for hex-part components. Thus rectangular materials such as 4 foot by 8 foot plywood sheets, sheet metal or other generally available panel material can be utilized in the creation of flat panels with minimum waste.

Method of Forming a Structural Panel

A second embodiment of the invention is a structural panel such as panel 130 as shown in FIG. 20 and a method of forming same. The structural panel 130 of FIG. 20 is comprised of a plurality of connected multi-conic shells 129 attached on one or both sides to a flat panel such as panel 131 and/or panel 132, to create a sandwich panel. Such a structural panel 130 can be used for wall construction, foundation support, or other structural membranes. As in the multi-conic shell building structure disclosed above, the multi-conic shell structural panel provides increased structural support and loading capacity per unit weight by virtue of the radial distribution of loading forces into tension and compression forces throughout the multi-conic shell structure. Additionally, if a pattern of cone segments is employed so that an interlocking network of tetrahedron structures is expressed within the multi-conic shell(s) and top and/or bottom flat panels (as in the structural panel 130, an example tetrahedron 133 is illustrated in multi-conic shell 129 connecting vertices 135*a*, 135*b*, 135*c*, and 135*d*), further gains in strength per unit weight are provided. Structural panels may be constructed of sheet metal, plastic, concrete, wood, or other suitable material.

Figures 1, 14B:
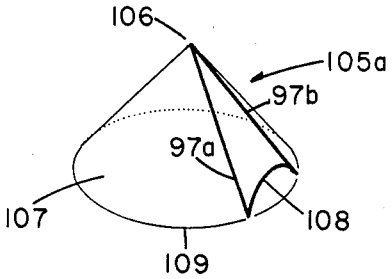
Figures 2, 14B:
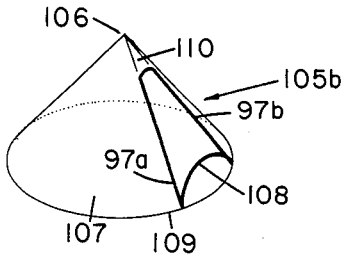
Figures 3, 14B:
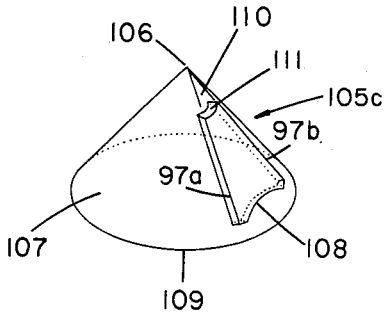
Figures 4, 14B:
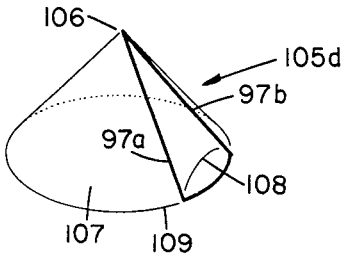
Figures 5, 14B:
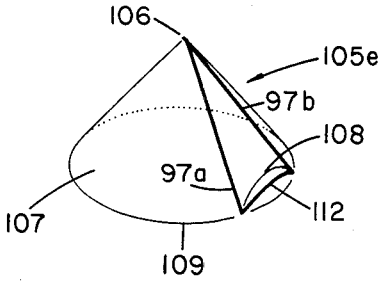
Figures 6, 14B:
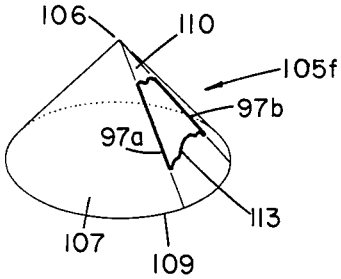

An example of a structural panel 130 formed according to the teachings of a second embodiment of the present invention is illustrated in FIG. 20. Structural panel 130 is a sandwich construction formed from a multi-conic shell structure 129 and a top and bottom panel 131 and 132. The multi-conic shell 129 is sandwiched between flat panels 131 and 132 which provide stiffening and completes the structural panel 130. Vertices (some examples of which are shown as 136 and 137 of respectively regular and inverted cone segments) form support points for bottom and top flat panels 131 and 132 respectively. The inverted and regular vertices may be truncated (not shown in FIG. 20 but shown in FIGS. 14*a*-1 thru 14*a*-6 and 14*b*-1 thru 14*b*-6) to provide more surface area for connection to the flat panels 131 and 132 thus providing a secure purchase. A single tri-part 98*c* with the vertex truncated is shown in FIG. 14*a*-3. A single hex-part 105*c* with the vertex truncated is shown in FIG. 14*b*-3.

Plan view 138 and oblique view 139 in FIG. 20 illustrates the steps for constructing the example structural panel 130. The layout 127 of cone vertices and bases corresponding to the theoretical array (as previously discussed) is shown, a pattern 128 of cone segments is designed, a corresponding multi-conic shell 129 is constructed, and flat panels 131 and 132 are attached to top and bottom sides respectively of the multi-conic shell 129 forming the sandwich panel 130.

To construct a structural panel, for example the structural panel illustrated in FIG. 20, using component flat materials such as sheet metal, plywood, or other flat material requires the following steps:

STEP ONE. A pattern 128 of cone segments, an example of which is shown in FIG. 20 corresponding to cone segments from alternately oriented cones, is devised and designed such that all cone segments meet and attach to other cone segments to form a multi-conic shell structure 129 having a desired layout for the structural panel 130. In FIG. 20, the regions labeled 140 are tri-parts and the regions labeled 141 are hex-parts. This design process determines a specific implementation of the invention. A pattern 128 of alternately oriented cone segments comprising one or a plurality of multi-conic surfaces and corresponding to a theoretical array 127 is devised. Thus, one or a plurality of multi-conic shells 129 can be constructed from the pattern. The theoretical array has been previously described in detail in connection with FIGS. 11*b*-1 thru 11*b*-3. The pattern 128 in plan view 138 shows hyperbolic line connections between similarly oriented regular parent cones (not shown) as dash-dot-dash lines; hyperbolic line connections between similarly oriented inverted parent cones (not shown) are shown as dashed lines.

STEP TWO. A plurality of flat two-dimensional panels (not shown in FIG. 20, however a single example 28 is shown in FIG. 15*d*) is initially constructed or manufactured to correspond to multi-conic surfaces in their uncurved and flat configuration. The two-dimensional panels are manufactured with perimeter dimensions equal to the perimeter dimensions of the multi-conic surfaces in their uncurved and flat configuration. The derivation of perimeter dimensions for cone regions corresponding to an array of theoretical cones has been discussed above. In some instances it may be preferred that each two-dimensional panel (an example 28 of which is shown in FIG. 15*d*) be constructed from a plurality of rectangular flat materials such as plywood, sheet metal, or other suitable flat material.

STEP THREE. Said two-dimensional panels are forced by bending into appropriate curved positions by the use of hand labor, computer aided machining equipment, or other mechanical devices, thus creating multi-conic shells; an example 114 of such a multi-conic shell is shown in FIG. 15*c*.

STEP FOUR. Adjacent multi-conic shells, the borders of which correspond to similarly oriented regular and/or inverted cones are connected along coincident edges, said edges generally comprising a hyperbolic curve (shown as dashed and dash-dot-dash lines in the plan view 138 of FIG. 20 as part of the cone segment pattern 128) by use of a glue bead, weld bead, or other fastening mechanisms (not shown) thus completing the multi-conic shell structure.

STEP FIVE The multi-conic shell structure is attached to flat panels (131 and 132) along top and bottom sides by gluing, welding, or other fastening mechanisms (as at regular parent cone vertices 136 and inverted parent cone vertices 137 some examples of which are shown in FIG. 20) to complete the structural panel.

Alternatively, only a single flat panel (for instance panel 131) is attached to one side of the multi-conic shell structure 129 to complete the structural panel (not shown). For the purposes of manufacturing, the vertices of either or both the regular and inverted cone segments may be truncated to provide a larger gluing surface without significant loss in strength.

In constructing a structural panel illustrated in FIG. 20 by casting moldable materials such as metal sheeting, plastic, or other molten or otherwise hardening materials, steps two through four above can be substituted with any of a variety of processes including: (1) the stamping, cold rolling, or hot rolling of metal or plastic materials, (2) vacuum forming, injection molding, or pressure molding of plastic materials, (3) concrete forming by use of ferro-cement, poured cement, or other cement process, (4) casting of metal, concrete, fiberglas, or other cast material, or (5) fiberglas forming by the use of chopper guns or other spray mechanisms. All of the above alternative processes involve the use of either positive or negative molds or both. Molds must be manufactured in accordance with the specifications of the specific implementation of the invention as determined in step one above.

Alternatives to the Regular Array

Although the theoretical array, and functional multi-conic shell designs that can be derived from it, are the most structurally stable and provide the greatest strength per unit weight for building structures and structural panels constructed under the teachings of this invention, it may be desirable to, in some instances, utilize other patterns of intersecting regular and inverted cones. However, for the purposes of creating special shaped, lightweight structures, the theoretical array can be altered somewhat without greatly compromising the inherent strength of the equilateral triangular (and therefore tetrahedron based) theoretical array. Such an alteration may be useful for inclusion in the interior portion 142 of an aircraft wing 143 an example of which is shown in FIG. 22, or for inclusion in the roof/wall surface (e.g. 144–147) of a building structure such as building structures 148–151 in FIGS. 21*a* thru 21*d*, to conform to steep or uneven terrain. Other applications of the invention may require further modifications in the theoretical array. A method of altering the theoretical array to accommodate various shapes will now be discussed.

The array of theoretical regular and inverted cones (as shown in FIGS. 11*a* and 11*b*-1 thru 11*b*-3 and previously disclosed) extends infinitely in both x and y Cartesian coordinate directions (the plane defined by the x and y Cartesian axes being parallel to planes 152 and 153 in FIG. 11*a*). The z direction extension (normal to planes 152 and 153) is limited by the distance of separation between the plane 152 containing the regular cone vertices and the plane 153 containing inverted cone vertices. Being an equilateral triangular array, each vertex occupies a geometrically predictable and regular position in the theoretical array.

By introducing a simple or complex modification of the defined positions of the regular and inverted cone vertices as they occur in the theoretical array, a modification in the otherwise symmetrical array can be made. For instance, such a modification can be made by displacing any vertex in the theoretical array in any direction in three dimensional space. By introducing such a modification in the positions of the vertices of regular and inverted cones as they occur in the theoretical array, the subsequent multi-conic surface and component cone segments will also be modified. Thus a modified theoretical array may contain cones with elliptical bases, cones with different length axis, and cones displaced in three-dimensional space from their position in the original theoretical array. Despite the introduction of such modifications, the surfaces of cones derived from the modified theoretical array will still satisfy the definition of a cone in that the surface of each cone, no matter how modified the position of the vertices, will remain a surface which can be cut from vertex to base and flattened by uncurving to form a flat two-dimensional surface. Likewise, any cone segment, no matter how modified it's parent theoretical cone, will flatten into a two-dimensional surface. Thus, any multi-conic shell congruent to a portion of a modified theoretical array of cones, will unbend and flatten so that it forms a flat two-dimensional surface (this assumes that cone regions are non-intersecting). Therefore any modification may be mathematically introduced into the placement of the regular and/or inverted cone vertices which make up a theoretical array of cones and it will remain possible to create two-dimensional flat panels made of plywood, sheet metal, or other flat material which correspond to the shape of multi-conic surfaces in their flat configuration, said multi-conic surfaces corresponding to the modified array of theoretical cones. The two-dimensional panels may subsequently be flexed and forced into the shape of the multi-conic surface thus becoming a multi-conic shell congruent to the modified theoretical array of cones. Such a modification may be desirable for the design and construction of special shaped building structures which must conform to variable land terrain (as examples 149–151 in FIGS. 21*a* thru 21*d*) or for the construction of special shaped multi-conic shells (as example airfoil 143 in FIG. 22) which may be sandwiched between curved or otherwise distorted top and bottom panels as in airplane wings, nose cones, and other structural objects to create non-flat structural panels.

FIGS. 21*a* thru 21*d* show a plan view 148, and three elevation views 149–151 corresponding to three different building structures. All three structures share the same plan design 148 but differ in vertical orientation so as to accommodate various surface slope angles 154–156. As can be seen, as the ground slope increases from angle 154 to 156 the area of the multi-conic shell increases and the overall shape of the structure becomes skewed. However, in all three cases roof/wall shells 145–147 remain multi-conic shells as previously described. Further, all three structures 149–151 can be constructed by the method of forming a building structure as previously disclosed.

Figure 22A:
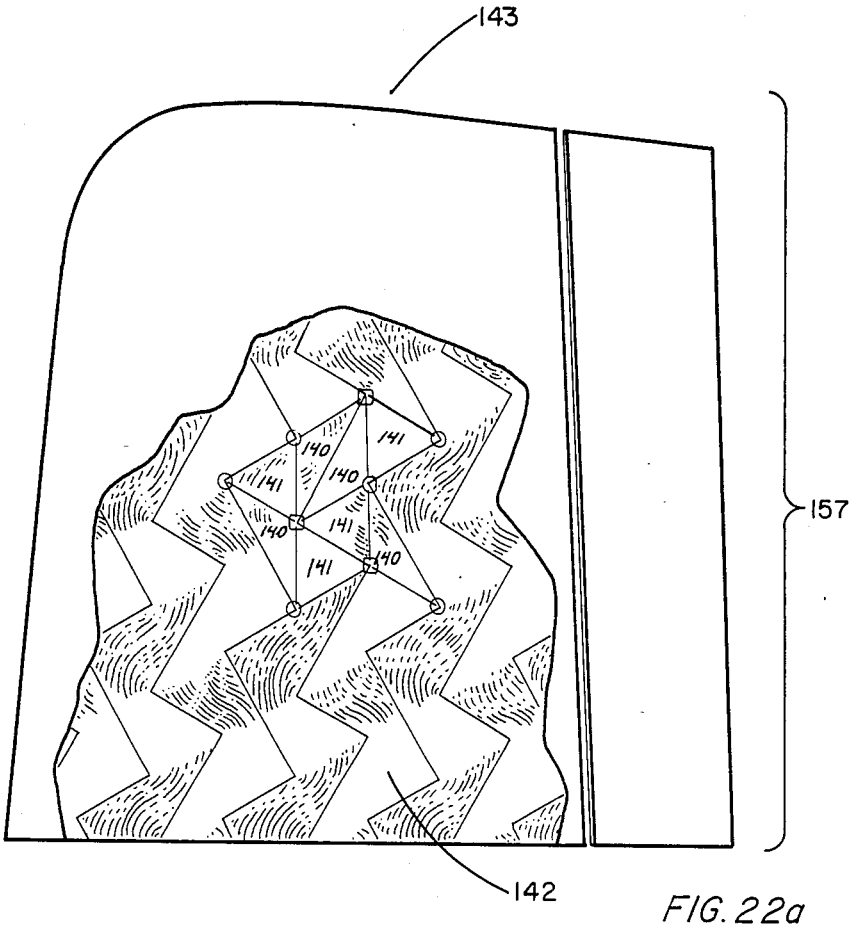
FIGS. 22a and 22b are a plan and an oblique view of an airfoil showing in cut-away section a multi-conic shell acting as internal structure.
Figure 22B:
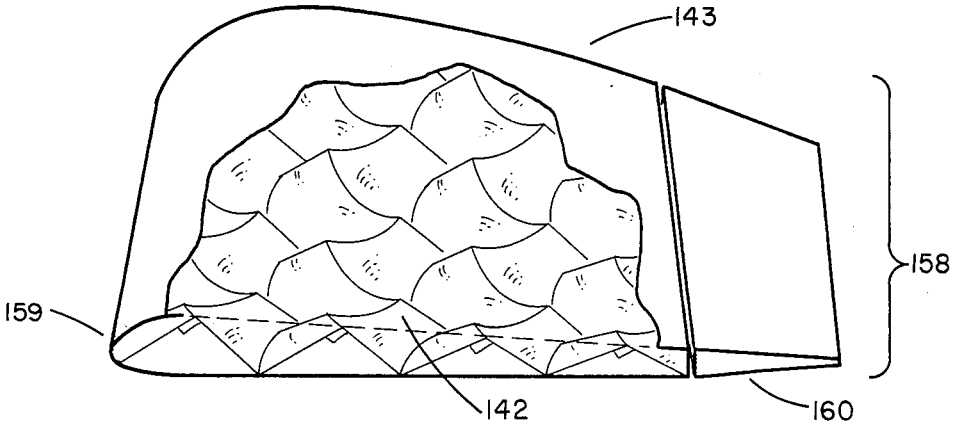

FIGS. 22*a* and 22*b* show a plan view 157 and an oblique view 158 of an aircraft wing section 143 with a cut-away view of an internal multi-conic shell 142 comprising (with the exterior of the wing) a structural panel 143 which has been manufactured in accordance with the teachings of the invention. In plan view 157 a portion of the multi-conic shell 142 has been labeled to show the pattern of hex-parts 141 and tri-parts 140 used in creating the multi-conic shell 142. Circles have been drawn around regular parent cone vertices (parent cones which open toward the bottom of the wing section) where vertices are part of numbered cone segments. Squares have been drawn around inverted parent cone vertices where vertices are part of numbered cone segments. By virtue of the wing's common shape, bulbous at the leading edge 159 and tapering aft 160, the structural panel 143 has been designed to follow the shape of the wing. By modifying the theoretical array, the vertical placement of the vertex of each parent cone has been forced to correspond with the wing's surface. Thus a structural panel 143 corresponding to the irregular wing shape has been provided by modifying the theoretical array of cones.

The above description is intended to be exemplary and not limiting. In view of the above disclosure and without departing from the scope of the invention, many modifications and substitutions will be obvious to one of average skill in the art. For example, other embodiments of the invention include:

(1) the manufacture and use of multi-conic acoustic tile or acoustic wall and ceiling covering for the dispursement of sound as in a recording studio, sound stage, or other acoustic application, (2) the manufacture and use of a wave suppression device having a multi-conic surface for use as a breakwater, sea-vessel stabilizer, or other liquid wave suppression device, (3) the manufacture and use of a decorative display having a multi-conic surface for which the primary structural requirement is that the display be self-supporting, (4) the manufacture and use of impact load cushioning devices which include a multi-conic surface such as the sole of shoes or the tread of tires where one side of joined multi-conic shells is filled with a flexible solid material such as rubber or other flexible filling, and (5) the manufacture and use of a concrete slab floor where one side of joined multi-conic shells is filled with concrete or other solid forming material.

I claim:

1. A shell congruent to a surface, said surface comprising:

a first convex region of a first cone; and a second concave region of a second cone;

said first region and said second region each having positive area, said first cone being oppositely oriented to said second cone, said first cone being tangent to said second cone along a line segment, said line segment being common to a generator line of said first cone and a generator line of said second cone, said line segment being a portion of the perimeter of said first and said second regions, said shell, by virtue of being congruent to said surface, therefore comprising a first convex portion congruent to said first region and a second concave portion congruent to said second region, said first and said second portions including a common linear portion congruent to said line segment, said first and said second portions together forming a portion of said shell congruent to the union of said first and said second regions.

2. A shell as in claim 1, further comprising means for restraining movement of said shell, said means of restraining movement contacting said shell so as to maintain congruent of said first poriton of said shell to said first region.

3. A shell as in claim 2 wherien said means for restraining is attached to said first portion of said shell.

4. A shell as in claim 3 wherein said means for restraining comprises a beam attached along said common linear portion.

5. A shell as in claim 3, wherein said means for restraining is attached to a perimeter segment of said first portion.

6. A shell as in claim 5, wherein said perimeter segment is congruent to a hyperbolic curve.

7. A roof/wall portion of a building including one or more shells as in claim 1.

8. A shell as in claim 1 further including at least one panel attached to said shell so that a structural panel is formed.

9. A shell as in claim 8 wherein said panel is flat.

10. A shell as in claim 1, wherein said first region is selected from a set consisting of a hex-part and a tri-part and said second region is selected from a set consisting of a hex-part and a tri-part.

11. A shell as in claim 10, wherein the parent cone of said hex-part has a vertex angle of approximately 97 degrees and wherein the parent cone of said tri-part has a vertex angle of approximately 97 degrees.

12. A shell as in claim 1 wherein said first cone and said second cone are right circular cones.

13. A shell as in claim 1 wherein said shell has an opening therein.

14. A shell as in claim 13 wherein said opening is completely surrounded by a plurality of portions of said shell, said portions being congruent to conic regions, said plurality including said first portion of said first cone and said second portion of said second cone.

15. A shell as in claim 1 wherein said surface further includes a third convex region having positive area of a third cone, said third cone being oppositely oriented to said second cone and tangent to said second cone along a line segment common to a generator line of said second cone and a generator line of said third cone, said line segment being contained in the perimeter of said second and said third regions, so that said shell includes a portion congruent to the region consisting of the union of said first region, said second region, and said third region.

16. A building structure comprising a multi-conic shell, said multi-conic shell comprising a surface, said surface comprising:

a first convex region of a first cone; and a second concave region of a second cone;

said first region and said second region each having positive area, said first cone being oppositely oriented to said second cone, said first cone being tangent to said second cone along a line segment, said line segment being common to a generator line of said first cone and a generator line of said second cone, said line segment being a portion of the perimeter of said first and said second regions.

17. A building structure as in claim 16, wherein at least one of said first cone and said second cone is a right circular cone.

18. A building structue as in claim 16, wherein said multi-conic shell attaches to an existing structure.

19. A shell as in claim 18 further including a third convex region of positive area, a fourth convex region of positive area and a fifth convex region of positive area of a third, a fourth and a fifth cone, respectively, said third, fourth and fifth cones having the same orientation as said first cone, the vertices of said first, third, fourth and fifth cones lying in the same plane.

20. A shell as in claim 19 wherein three of said vertices form an equilateral triangle and wherein said first, third, fourth and fifth cones are right circular cones having parallel axes.

21. A solid having a surface, said surface comprising at least:

a first convex region of a first cone; and a second concave region of a second cone;

said first region and said second region each having positive area, said first cone being oppositely oriented to said second cone, said first cone being tangent to said second cone along a line segment common to a generator line of said first cone and a generator line of said second cone, said line segment being a portion of the perimeter of said first and said second regions.

22. A shell congruent to a surface, said surface comprising:

a first convex region of a first cone; and a second concave region of a second cone;

said first region and said second region each having positive area, said first cone being oppositely oriented to said second cone, said first cone being tangent to said second cone along a line segment, said line segment being common to a generator line of said first cone and a generator line of said second cone, said line segment being a portion of the perimeter of said first and said second regions.

* * * * *